US012746441B2

(12) United States Patent
Kent

(10) Patent No.: US 12,746,441 B2
(45) Date of Patent: Sep. 29, 2026

(54) SPORTING ARTICLES

(71) Applicant: Aerotec Power Pty Ltd, Benowa (AU)

(72) Inventor: Cameron Kent, Benowa (AU)

(73) Assignee: AEROTEC POWER PTY LTD, Benowa (AU)

( * ) Notice: Subject to any disclaimer, the term of this patent is extended or adjusted under 35 U.S.C. 154(b) by 902 days.

(21) Appl. No.: 18/053,677

(22) Filed: Nov. 8, 2022

(65) Prior Publication Data

US 2023/0166166 A1 Jun. 1, 2023

Related U.S. Application Data

(63) Continuation-in-part of application No. 17/627,865, filed on Jan. 18, 2022.

(51) Int. Cl.

| | |
|---|---|
| ***A63B 60/00*** | (2015.01) |
| ***A42B 3/04*** | (2006.01) |
| ***A63B 49/02*** | (2015.01) |
| ***A63B 53/04*** | (2015.01) |
| ***A63B 53/06*** | (2015.01) |

(52) U.S. Cl.

CPC ..... *A63B 60/006* (2020.08); *A42B 3/0493* (2013.01); *A63B 49/02* (2013.01); *A63B 53/0445* (2020.08); *A63B 2053/0495* (2013.01); *A63B 53/06* (2013.01)

(58) Field of Classification Search

CPC ... A63B 60/006; A63B 49/02; A63B 53/0445; A63B 53/06; A63B 2053/0495; A63B 60/16; A63B 49/08; A63B 53/042; A63B 53/0437; A63B 53/0466; A63B 53/08; A63B 60/02; A42B 3/0493

See application file for complete search history.

(56) References Cited

U.S. PATENT DOCUMENTS

| | | | |
|---|---|---|---|
| 645,942 | A | 3/1900 | Cran |
| 690,940 | A | 1/1902 | Febiger |
| 1,133,129 | A | 3/1915 | Govan |
| 1,453,503 | A | 5/1923 | Holmes |
| 1,538,312 | A | 5/1925 | Neish |
| 1,840,924 | A | 1/1932 | Tucker |
| 2,460,445 | A | 2/1949 | Bigler |
| 2,592,013 | A | 4/1952 | Curley |

(Continued)

FOREIGN PATENT DOCUMENTS

| | | | |
|---|---|---|---|
| CN | 202699992 | U | 1/2013 |
| DE | 3711964 | A1 | 10/1988 |

(Continued)

OTHER PUBLICATIONS

JP-2001259089-A Translated (Year: 2001).*

(Continued)

*Primary Examiner* — Jeffrey S Vanderveen

(74) *Attorney, Agent, or Firm* — HOLZER PATEL DRENNAN

(57) ABSTRACT

An aerodynamic sporting item, such as a tennis racket, is provided. The item includes a plurality of ridges on a surface of the sporting item. The ridges are aligned with a direction of flow of air across the sporting item when used. The ridges define channels between adjacent pairs of ridges and a plurality of dimples are located in the channels defined by the ridges.

19 Claims, 26 Drawing Sheets

(56) References Cited

U.S. PATENT DOCUMENTS

| | | | | | |
|---|---|---|---|---|---|
| 3,212,783 | A | | 10/1965 | Bradley et al. | |
| 3,589,731 | A | | 6/1971 | Chancellor | |
| 3,652,094 | A | | 3/1972 | Glover | |
| 3,897,066 | A | | 7/1975 | Belmont | |
| 3,979,123 | A | | 9/1976 | Belmont | |
| 3,997,170 | A | * | 12/1976 | Goldberg | A63B 53/04 473/328 |
| 4,052,075 | A | | 10/1977 | Daly | |
| 4,065,133 | A | | 12/1977 | Gordos | |
| 4,688,798 | A | | 8/1987 | Pelz | |
| 4,730,830 | A | | 3/1988 | Tilley | |
| 4,754,974 | A | | 7/1988 | Kobayashi | |
| 4,944,515 | A | | 7/1990 | Shearer | |
| 5,454,562 | A | | 10/1995 | Sommer | |
| 5,613,916 | A | | 3/1997 | Sommer | |
| 5,700,208 | A | * | 12/1997 | Nelms | A63B 53/0466 473/324 |
| 5,776,009 | A | | 7/1998 | Mcatee | |
| 6,001,029 | A | | 12/1999 | Kobayashi | |
| 6,012,989 | A | | 1/2000 | Saksun | |
| 6,089,993 | A | | 7/2000 | Woodward et al. | |
| 6,224,497 | B1 | | 5/2001 | Antonious | |
| 6,277,032 | B1 | | 8/2001 | Smith | |
| 6,402,636 | B1 | | 6/2002 | Chang | |
| 6,551,199 | B2 | | 4/2003 | Viera | |
| 6,776,725 | B1 | | 8/2004 | Miura et al. | |
| 7,354,355 | B2 | | 4/2008 | Tavares et al. | |
| 7,886,572 | B2 | | 2/2011 | Harpham | |
| 8,172,697 | B2 | | 5/2012 | Cackett et al. | |
| 8,591,352 | B2 | | 11/2013 | Hirano | |
| 8,678,946 | B2 | | 3/2014 | Boyd et al. | |
| 8,986,132 | B2 | | 3/2015 | Chen | |
| 9,180,349 | B1 | | 11/2015 | Seluga et al. | |
| 9,216,332 | B1 | | 12/2015 | Ehlers et al. | |
| 9,486,676 | B1 | | 11/2016 | Thall et al. | |
| 9,750,992 | B2 | | 9/2017 | Knutson et al. | |
| 9,914,027 | B1 | | 3/2018 | Harbert et al. | |
| 9,999,813 | B2 | | 6/2018 | Cleghorn et al. | |
| 10,245,481 | B1 | * | 4/2019 | Cleghorn | A63B 60/52 |
| 10,596,428 | B1 | | 3/2020 | Rumble | |
| 10,695,626 | B2 | | 6/2020 | Bennett et al. | |
| 2002/0065143 | A1 | | 5/2002 | Shin | |
| 2005/0181884 | A1 | | 8/2005 | Beach et al. | |
| 2005/0209021 | A1 | | 9/2005 | Hoffman et al. | |
| 2005/0221911 | A1 | | 10/2005 | Beach et al. | |
| 2006/0191061 | A1 | * | 8/2006 | Rampell | A42B 1/008 2/410 |
| 2007/0149310 | A1 | | 6/2007 | Bennett et al. | |
| 2008/0039228 | A1 | | 2/2008 | Breier et al. | |
| 2008/0188320 | A1 | | 8/2008 | Kamatari | |
| 2011/0152001 | A1 | | 6/2011 | Hirano | |
| 2012/0302367 | A1 | | 11/2012 | Myrhum et al. | |
| 2012/0322573 | A1 | * | 12/2012 | Boyd | A63B 60/00 473/282 |
| 2013/0053170 | A1 | | 2/2013 | Rife | |
| 2013/0244808 | A1 | | 9/2013 | Bennett et al. | |
| 2014/0057737 | A1 | * | 2/2014 | Solheim | A63B 53/08 29/527.1 |
| 2016/0166891 | A1 | | 6/2016 | Narita et al. | |
| 2016/0250534 | A1 | | 9/2016 | Solheim et al. | |
| 2017/0312591 | A1 | * | 11/2017 | Saso | A63B 53/0466 |
| 2017/0354852 | A1 | | 12/2017 | Bennett et al. | |
| 2018/0099189 | A1 | | 4/2018 | Sanchez et al. | |
| 2018/0140906 | A1 | | 5/2018 | Stokke et al. | |
| 2018/0326268 | A1 | | 11/2018 | Yi et al. | |
| 2018/0353818 | A1 | * | 12/2018 | Henrikson | A63B 53/04 |
| 2019/0046846 | A1 | | 2/2019 | Sargent et al. | |
| 2019/0105544 | A1 | | 4/2019 | Carter | |
| 2019/0290976 | A1 | | 9/2019 | Bennett et al. | |
| 2021/0308535 | A1 | | 10/2021 | Boggs | |
| 2024/0350869 | A1 | * | 10/2024 | Park | B29C 43/003 |

FOREIGN PATENT DOCUMENTS

| | | | | | |
|---|---|---|---|---|---|
| JP | 10234892 | A | | 8/1998 | |
| JP | H10234892 | A | | 9/1998 | |
| JP | 11178957 | A | | 7/1999 | |
| JP | 2001259089 | A | * | 9/2001 | A63B 53/0466 |
| JP | 2002085606 | A | | 3/2002 | |
| JP | 2002272883 | A | * | 9/2002 | A63B 60/006 |
| JP | 2009000281 | A | * | 1/2009 | |
| KR | 20100033268 | A | | 3/2010 | |
| WO | WO-9400203 | A1 | * | 1/1994 | F15D 1/12 |
| WO | 2021012002 | A1 | | 1/2021 | |

OTHER PUBLICATIONS

JP-2002272883-A Translated (Year: 2002).*

JP-2009000281-A Translated (Year: 2009).*

"International Preliminary Report on Patentability", for PCT/AU2020/050743, mailed Oct. 20, 2020, 13 pages.

"International Search Report and Written Opinion", in PCT/AU2020/050743, mailed Aug. 18, 2020, 24 pages.

Kozuchowski, Z., ""Review: Callaway GBB Epic and Epic Sub Zero Drivers"", [retrieved from internet on Jan. 14, 2022 <URL: http://www. golfwrx.com/ 420618/review-callaway-gbb-epic-and-epic-sub-zero-drivers/>, Jan. 17, 2017.

International Search Report and Written Opinion issued in PCT/AU2020/050743, mailed on Aug. 18, 2020, 24 pages.

International Preliminary Examining Authority, International Preliminary Report on Patentability for PCT/AU2020/050743, mailed Oct. 20, 2020, 13 pages.

Kozuchowski, Z., 'Review: Callaway GBB Epic and Epic Sub Zero Drivers',Jan. 4, 2017 [retrieved from internet on Jan. 14, 2022 <URL: http://www. golfwrx.com/ 420618/review-callaway-gbb-epic-and-epic-sub-zero-drivers/>.

* cited by examiner

SPORTING ARTICLES

CROSS-REFERENCE TO RELATED APPLICATIONS

This application is a continuation-in-part of pending U.S. patent application Ser. No. 17/627,865 filed Jul. 19, 2019, titled "IMPROVED SPORTING ARTICLES" which is a § 371 national phase filing of pending application number PCT/AU2020/050743 entitled "IMPROVED SPORTING ARTICLES" filed on Jul. 17, 2020, which is related to and claims benefit of priority to Australian Patent App. No. 2019902565, entitled "IMPROVED SPORTING ARTICLES" filed on Jul. 19, 2019, and Australian Patent App. No. 2019903968, entitled "IMPROVED SPORTING ARTICLES" filed on Oct. 22, 2019, and claims priority to Australian Patent App. No. 2021266200 filed Nov. 8, 2021, the entire disclosures of each of the foregoing is incorporated herein by reference.

TECHNICAL FIELD

The present invention relates to improved sporting articles, including clubs, rackets, bats and sticks, and helmets, such as motorcycle and bicycle helmets. In particular, although not exclusively, the present invention relates to an improved tennis racket.

BACKGROUND ART

When swinging a golf club, the head of the club travels through the air at significant speed, and as a result, is subject to significant wind resistance. In particular, drag acts in a direction opposite to a motion of the golf club head, and ultimately reduces the speed of the swing.

For an average male golfer, the head of a driver may be travelling at up to 95 mph/152 km/h, and for a long-drive professional the head may be travelling at up to 150 mph/241 km/h. At these speeds, the wind resistance causes significant resistance on a body of the golfer, which may cause injury. Furthermore, the drag reduces the speed of the club head, which equates to reduced distance ball travel.

Many attempts have been made to improve the flow of air around a golf club head, and thereby reduce the drag on the head during a swing. Initially, golf club heads were given an aerodynamic shape, often teardrop-shaped in cross section. A problem with such golf club heads is that they still generated significant wind resistance.

More recently, cavities (cutouts) were used to break vortices generated behind the golf club head to reduce the drag. The cavities (cutouts) are generally several centimetres in size and may take various shapes. A problem with the use of such cavities (cutouts) is that due to their size, they significantly change the characteristics of the golf club head, including changing the shape and overall volume of the club head, and reduce the visual appeal of the golf club.

A further problem with the use of such cavities (cutouts) is that the United States Golf Association (USGA) is very strict regarding the presence of cavities (cutouts) in golf club heads. As such, it is not possible to position cavities (cut outs) in their desired positions from a drag perspective while maintaining compliance with USGA standards.

A further problem with golf clubs is that the drag of the head during a swing causes the club to flex, which is beneficial when hitting a ball. Significantly reducing the drag of a golf club head changes the characteristics of the golf club, including the way the club flexes, which in turn influences how the head hits the ball. As such, changing the aerodynamics of a golf club head is a complex, and influences the golf club in its entirety.

Yet another problem with golf clubs of the prior art is that they generally have a fixed structure, and are not readily adaptable. As a result, fitting clinics are provided where a professional assists a golfer in choosing and fitting a set of clubs to his or her needs. While fitting clinics are good at helping a golfer choose a set of clubs, the clubs generally remain static after fitting, even when the golfer's skill, swing speed and needs change.

Many attempts have been made to change aerodynamics of other types of sporting articles, such as clubs, rackets, bats and sticks. For example, tennis, squash and badminton rackets, baseball bats, hockey sticks and the like are swung through the air at great speeds, and face similar problems to that of golf clubs mentioned above.

Similarly, helmets often travel through the air at great speeds and thus face similar problems. A further problem with helmets is that the desire to have a cool, comfortable helmet is in direct conflict with aerodynamics. Furthermore, helmets that have good airflow through them (e.g. bicycle helmets with large holes), in addition to being poorly aerodynamic, are not well suited to use in rain as the rider's head gets wet. Helmets that are generally closed, such as motorcycle helmets, may be better at keeping rain out, but often have problems with ventilation in the helmet and fogging of the visor, creating a dangerous situation for the rider.

As such, there is clearly a need for improved sporting articles, such as clubs, rackets, bats, sticks, helmets and the like.

It will be clearly understood that, if a prior art publication is referred to herein, this reference does not constitute an admission that the publication forms part of the common general knowledge in the art in Australia or in any other country.

SUMMARY OF INVENTION

The present invention is directed to sporting articles, such as clubs, rackets, bats, sticks and helmets, which may at least partially overcome at least one of the abovementioned disadvantages or provide the consumer with a useful or commercial choice.

With the foregoing in view, the present invention in one form, resides broadly in an aerodynamic sporting item including:

- a plurality of ridges on a surface of the sporting item, the ridges aligned with a direction of flow of air across the sporting item when used, the ridges defining channels between adjacent pairs of ridges; and
- a plurality of dimples located in the channels defined by the ridges.

Preferably, the dimples are arranged in one or more rows in the channels.

Preferably, the dimples are arranged in a single row in each of the channels.

Preferably, each dimple extends across at least 50% of a width of a corresponding channel.

Preferably, the sporting item comprises an implement configured to be swung by a user, the channels aligned with the direction of flow of air across the sporting implement when swung.

Preferably, the sporting implement comprises a tennis racket.

Preferably, the tennis racket comprises a handle and a frame extending from the handle, wherein at least 50% of a surface of the frame is covered with dimples.

Preferably, the one or more rows of dimples are perpendicular to a striking face of the sporting implement.

Preferably, the sporting item further comprises a chamber defined in the sporting implement, the chamber including one or more weights movable within the chamber to adjust a balance of the sporting implement.

Preferably, the sporting item further includes a handle, wherein the chamber is defined in the handle.

Preferably, the dimples comprise spherical dimples.

Preferably, the dimples are between about 0.4 mm and 1.0 mm in depth and between about 1.0 mm and 5.0 mm in diameter.

Preferably, the channels are curved in cross section.

Preferably, the channels curve continuously between adjacent pairs of ridges.

Preferably, the ridges comprise an elongate point between adjacent channels.

Preferably, the channels are between about 0.2 mm and 3 mm in depth and 5 mm in width.

Preferably, the sporting item comprises a helmet configured to be worn by a user.

Preferably, the dimples are arranged in one or more rows in the channels, the one or more rows extending in a direction from a front to a rear of a helmet.

Preferably, one or more of the channels are associated with an air vent, the one or more channels configured to encourage the flow of air in relation to the air vent.

In another form, the invention resides broadly in a bumper for a tennis racket, the bumper including:

- a plurality of ridges on an outer surface of the bumper, the ridges configured to be aligned with a direction of flow of air across the tennis racket when installed on a racket and the racket is swung, the ridges defining channels between adjacent pairs of ridges; and
- a plurality of dimples located in the channels defined by the ridges.

In another form, the invention resides broadly in a golf club including a head, the head including

- a plurality of dimples, configured to decrease drag of the head when swung by the user; and
- a chamber defined in the head, the chamber including one or more weights movable within the chamber to adjust a balance of the golf club head.

Advantageously, the use of dimples greatly increases aerodynamic efficiency of the golf club head and thereby the golf club. The movable weights enable adjustments to be made to compensate for changes in characteristics of the golf club associated with the increased aerodynamic efficiency.

Preferably, the dimples comprise spherical dimples. Alternatively, the dimples comprise hexagonal dimples.

The dimples may be between about 0.01 mm and 1.5 mm in depth and about 0.5 mm and 3 mm in diameter. In other embodiments, the dimples may be between about 4 mm and about 6 mm in depth and/or diameter.

Preferably, the dimples do not include gripping edges at a junction between a surface of the body and the dimples. The dimples may extend into the body at an angle of less than about 45 degrees.

The one or more of the dimples may be located, at least partially, on a striking face of the golf club head, but be configured to not influence a golf ball struck with the striking face.

The striking face may include a plurality of elongate grooves, and at least some of the dimples are positioned between adjacent grooves.

The dimples may include first dimples and second dimples, the first dimples substantially uniform in size and shape, the second dimples substantially uniform in size and shape, and the first dimples different to the second dimples in at least one of size and shape.

At least some of the dimples may be arranged in rows, the rows parallel or perpendicular to an edge of the golf club.

At least 50% of a surface of the head may be covered with dimples.

The weights may be adjustable in position from an outside of the head of the golf club.

The chamber may be elongate, substantially in a direction perpendicular to a striking face of the golf club. The chamber is substantially uniform in cross-section.

The golf club head may include one or more weights biased against a front face of the club with a biasing member, such as a spring.

The one or more weights may be able to move fractionally within the chamber as the golf club hits a ball, to generate a pinging sound when the club hits a ball.

The golf club head may include a threaded rod, configured to engage with a weight in the chamber, to enable the weight to be moved along a length of the chamber through rotation of the threaded rod.

The chamber may comprise a cylindrical chamber and the one or more weights may be disc-shaped.

The chamber may be centrally located in the golf club head. The chamber may be supported by one or more arms and an inside surface of the golf club head.

The golf club head may include a channel defined in a surface of the golf club head, wherein at least a subset of the dimples are defined in the channel.

The channel may be defined on a crown of the golf club head.

The channel may be tapered.

The channel may comprise a plurality of channels. The channels may be parallel.

The dimples may create a boundary layer of air that is turbulent and allows smoothly flowing air to travel thereover. The dimples may also result in a decrease in the size of a wake region behind the body when swung, thereby reducing overall drag.

The dimples may be located on one or more of a sole, a heel, a face, a hosel, a crown, a toe, a top, and a back of a golf club or golf club head.

In another form, the invention resides broadly in a helmet, comprising one or more air flow pathways from an inside of the helmet to an outside of the helmet, and a channel, the channel configured to guide a flow of air to create a low pressure in proximity to the air flow pathways to thereby draw air out from the helmet through the air flow pathways.

Advantageously, the use of the channel to draw air out of the helmet enables ventilation to be provided while providing aerodynamic efficiency.

The channel may include an opening at a front of the helmet, and at outlet at the rear of the helmet.

The channel may include a plurality of dimples at the opening. The channel may include a plurality of dimples along a length of the channel.

The channel may be at least partially enclosed. The channel may extend across a top of the helmet.

The channel may include a narrow central portion, configured to create the low pressure region. The channel may be configured to generate a venturi effect to thereby draw air from the helmet.

The channel may include a plurality of covers, configured to partially cover the air flow pathways. The covers may comprise reverse-cowl shaped covers. The covers may be adapted to prevent rain from entering the air flow pathways. The covers may sit above openings of the air flow pathways.

The air flow pathways may be arranged in rows.

The air flow pathways may include tube-shaped pathways. The air flow pathways may include grooves, open to an inside of the helmet.

The airflow pathways may be configured to extract air from around a visor of the helmet. This may in turn cause air to circulate over the internal surface of the visor, thereby decreasing fogging of the visor.

The channel may include an adjustable cover, configured to enable an amount of airflow into the channel to be adjusted.

In yet another form, the invention resides broadly in a sporting article adapted to be swung by a user, the sporting article including a body including one or more channels, and a plurality of dimples defined in the channels, the dimples and channels configured to decrease drag of the body when swung by the user.

Advantageously, the dimples and channels decrease drag without substantially altering the shape of the sporting article. As a result, less resistance is provided on a body of the player at a particular swing speed, thereby reducing the risk of injury. Alternatively, swing speeds may be increased.

The channels may extend in a direction of airflow in use. The channels may include a central channel extending in a direction of airflow in use, and one or more others channels, not extending in a direction of airflow in use.

Preferably, the sporting article includes a handle. Preferably, the sporting article includes a striking face, configured to strike a ball or other item (e.g. a puck).

Preferably, the sporting article comprises a golf club. The body may comprise a head of the golf club.

The dimples may be located on a striking face of the sporting article. The dimples may be configured to not influence an item (e.g. a ball or puck) struck with the striking face. In the case of a golf club, dimples on the striking face may be configured to not influence a golf ball (e.g. do not impart any significant additional spin on the golf ball).

In the case of a golf club, the striking face may include a plurality of elongate grooves, and at least some of the dimples may be positioned between adjacent grooves. The grooves may be parallel, and at least some of the dimples may form rows that are parallel with the grooves.

The sporting article may include a chamber including one or more weights movable within the chamber to adjust a balance of the sporting article. The chamber may comprise an internal chamber. The chamber may be defined in a handle of the sporting article.

The dimples may include first dimples and second dimples, the first dimples substantially uniform in size and shape, the second dimples substantially uniform in size and shape, and the first dimples different to the second dimples in at least one of size and shape.

The first dimples may be located on a first surface of the sporting article, and the second dimples may be located on a second surface of the sporting article. The first surface may comprise a striking face of the sporting article, and the second surface may be a non-striking face of the sporting article.

The body of the sporting article, or part thereof, may be formed of metal. The dimples may be cast into the body. The dimples may be machined, pressed, or stamped into the body. The body may be 3D printed.

The body of the sporting article, or part thereof, may be formed of resin, polycarbonate, composite material, or any other suitable material.

The body may be unitarily formed. Alternatively, the body may be formed of two or more components. For example, the body may be formed of metal, having a thin polycarbonate sleeve covering a portion thereof, at least some of the surface features defined in the polycarbonate sleeve.

In yet another form, the invention resides broadly in a covering, for attaching to and covering at least part of a head of a golf club, the covering including dimples defined in an outer surface thereof, for increasing aerodynamic efficiency of the golf club.

The covering may be adapted to cover at least a face of the golf club.

The covering may be clipped onto the golf club. The covering may be adhered to the golf club using adhesive.

In yet another form, the invention resides broadly in a sporting implement configured to be swung by a user, the sporting implement including:

- a plurality of ridges on a surface of the sporting implement, the ridges aligned with a direction of flow of air across the sporting implement when swung, the ridges defining channels between adjacent pairs of ridges; and
- a plurality of dimples located in the channels defined by the ridges.

The sporting article may comprise a tennis racket. The sporting article may comprise a racket, club, or bat.

The dimples may be arranged in one or more rows in the channels. The one or more rows may be aligned with the direction of flow of air across the sporting implement when swung.

The dimples are arranged in a single row in each of the channels.

Each dimple may extend across at least 50% of a width of the channel. Each dimple may extend across at least 70% of the width of the channel.

The dimples may be arranged in one to three rows in each of the channels.

The one or more rows of dimples may be perpendicular to a striking face of the sporting implement.

The tennis racket may comprise a handle and a frame extending from the handle. At least 50% of a surface of the frame may be covered with dimples. At least 70% of a surface of the frame may be covered with dimples. Substantially an entire surface of the frame may be covered with dimples.

The dimples may comprise spherical dimples.

The dimples may be between about 0.4 mm and 1.0 mm in depth. The dimples may be between about 1.0 mm and 5.0 mm in diameter.

The channels may be curved in cross section.

The channels may curve continuously between adjacent pairs of ridges.

The ridges may comprise an elongate point (or peak) between adjacent channels.

The channels may be between about 0.2 mm and 3 mm in depth and between about 1 mm and 5 mm in width.

The sporting implement may further comprise a chamber defined in the sporting implement. The chamber may include one or more weights movable within the chamber to adjust a balance of the sporting implement.

The sporting implement may include a handle, wherein the chamber is defined in the handle.

The weights may be adjustable in position from an outside of the sporting implement.

The sporting implement may include a threaded rod, configured to engage with the weights in the chamber, to enable the weights to be moved along a length of the chamber through rotation of the threaded rod.

The chamber may comprise a cylindrical chamber. The one or more weights may be disc-shaped.

The weights may be removable.

The dimples may be symmetrically arranged on the sporting implement.

In yet another form, the invention resides broadly in a bumper for a tennis racket, the bumper including:

a plurality of ridges on an outer surface of the bumper, the ridges configured to be aligned with a direction of flow of air across the tennis racket when installed on a racket and the racket is swung, the ridges defining channels between adjacent pairs of ridges; and a plurality of dimples located in the channels defined by the ridges.

The dimples, ridges and/or channels of the bumper may have any one or more characteristics of the dimples, ridges and/or channels of the tennis racket above.

In yet another form, the invention resides broadly in a bumper for a tennis racket, the bumper including a plurality of dimples on a surface of the bumper, for improving aerodynamics of a tennis racket when installed on the tennis racket.

The bumper may be removably coupled to the tennis racket.

Preferably, the dimples are arranged in rows.

Preferably, the rows are arranged orthogonal to a striking surface of the tennis racket in use.

Preferably, the bumper includes a plurality of ridges on a surface thereof, the ridges aligned with a direction of flow of air across the tennis racket when swung, the ridges defining channels between adjacent pairs of ridges, wherein the dimples are located in the channels defined by the ridges.

Preferably, the dimples are arranged in one or more rows in the channels, the one or more rows aligned with the direction of flow of air across the tennis racket when swung.

The dimples may be arranged in a single row in each of the channels. The dimples may be arranged in one to three rows in the channels.

Preferably, each dimple extends at least 50% of the width of the channel. Each dimple may extend across at least 70% of the width of the channel.

The one or more rows of dimples may be perpendicular to a striking face of the tennis racket when installed on the tennis racket.

Preferably, at least 50% of a surface of the bumper is covered with dimples. At least 70% of a surface of the frame may be covered with dimples. Substantially an entire surface of the frame may be covered with dimples.

The dimples may comprise spherical dimples.

The dimples may be between about 0.4 mm and 1.0 mm in depth. The dimples may be between about 1.0 mm and 5.0 mm in diameter.

The channels may be curved in cross section.

The channels may curve continuously between adjacent pairs of ridges.

The ridges may comprise an elongate point (or peak) between adjacent channels.

The channels may be between about 0.2 mm and 3 mm in depth and 5 mm in width.

Preferably, the bumper comprises a pair of ends, and an upper portion extending between the ends.

Preferably, the bumper is configured to protect strings of the racket.

The strings may extend through the bumper.

The bumper may be unitarily formed.

The bumper may be moulded.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

DESCRIPTION OF EMBODIMENTS

Figure 1:
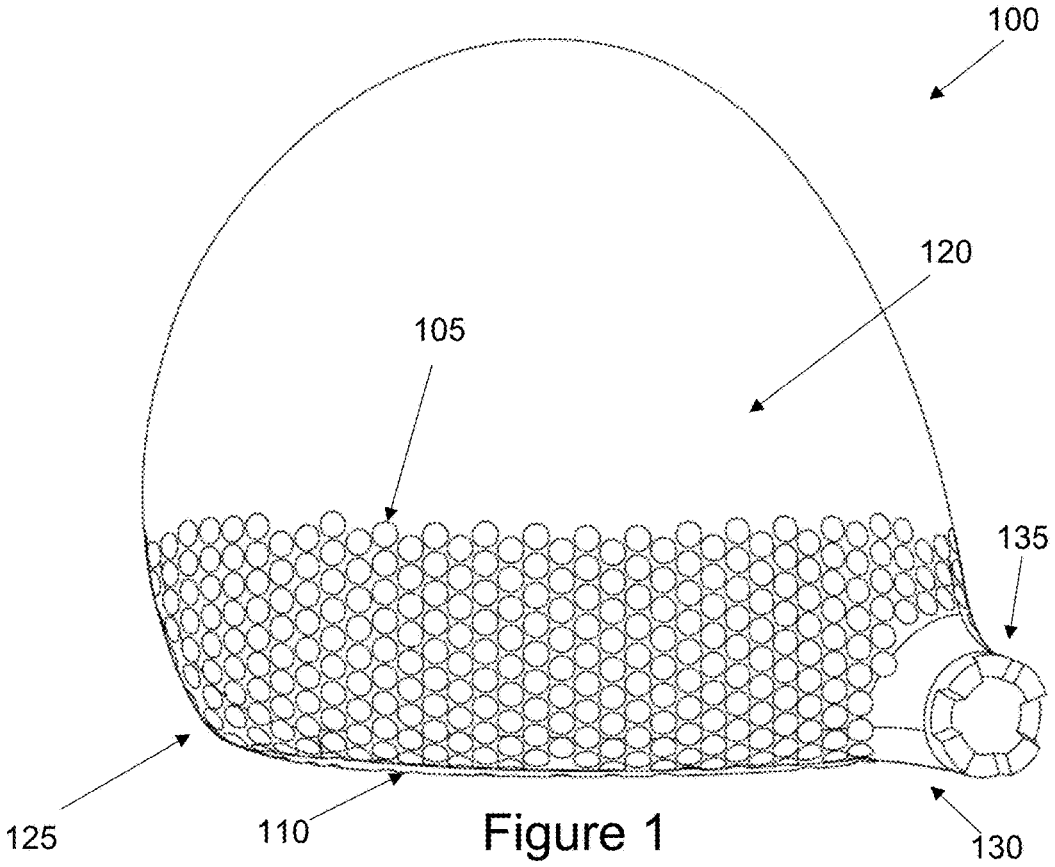
FIG. 1 illustrates a top view of a head of a golf club, according to an embodiment of the present invention.
Figure 2:
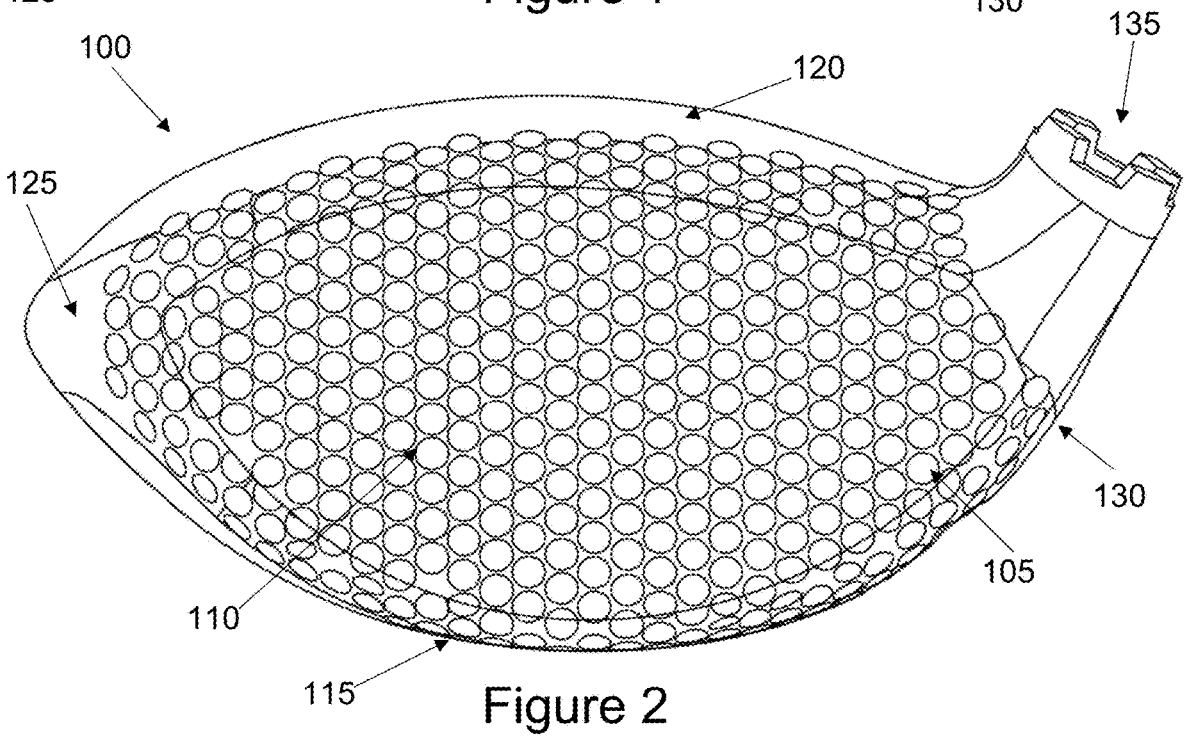
FIG. 2 illustrates a front view of the head of the golf club of FIG. 1.

FIG. 1 illustrates a top view of a head 100 of a golf club, according to an embodiment of the present invention. FIG. 2 illustrates a front view of the head 100 of the golf club. The head 100 includes a plurality of dimples 105, as outlined in further detail below, which are configured to generating a boundary layer of air to thereby decrease drag of the head 100 when swung.

Advantageously, the dimples 105 decrease drag of the head 100 without substantially altering the shape of the head 100. This enables improved aerodynamics to be achieved while maintaining compliance with USGA rules and the R & A Rules of Golf. With improved aerodynamics, less exertion may be required to swing the club at a desired speed, which in turn may be associated with a reduced risk of injury. Alternatively, the improved aerodynamics may be used to increased swing speeds. In order to compensate for the decreased drag, the head 100 is adjustable, as outlined below.

The golf club comprises a driver, and the head 100 includes a striking face 110, a sole 115, a crown 120, a toe 125, a heel 130 and a hosel 135. The dimples 105 are spherical dimples that are substantially uniform in size and shape, and extend substantially over an entirety of the striking face 110, and onto leading portions of the sole 115, crown 120, toe 125 and heel 130. These portions correspond to the high drag portions of the head 100 when swung.

The dimples 105 on the striking face 110 are configured to not influence a golf ball that is hit by the club. In particular, the dimples 105 on the face 110 are sized, shaped and positioned to not impart any significant additional spin on the golf ball with reference to a club that does not include such dimples 105. Such configuration enables the dimples 105 on the face 110 to have minimal effect on function of the striking face 110, while improving aerodynamics. This is particularly useful in maintaining compliance with standards, such as USGA standards.

Figure 3:
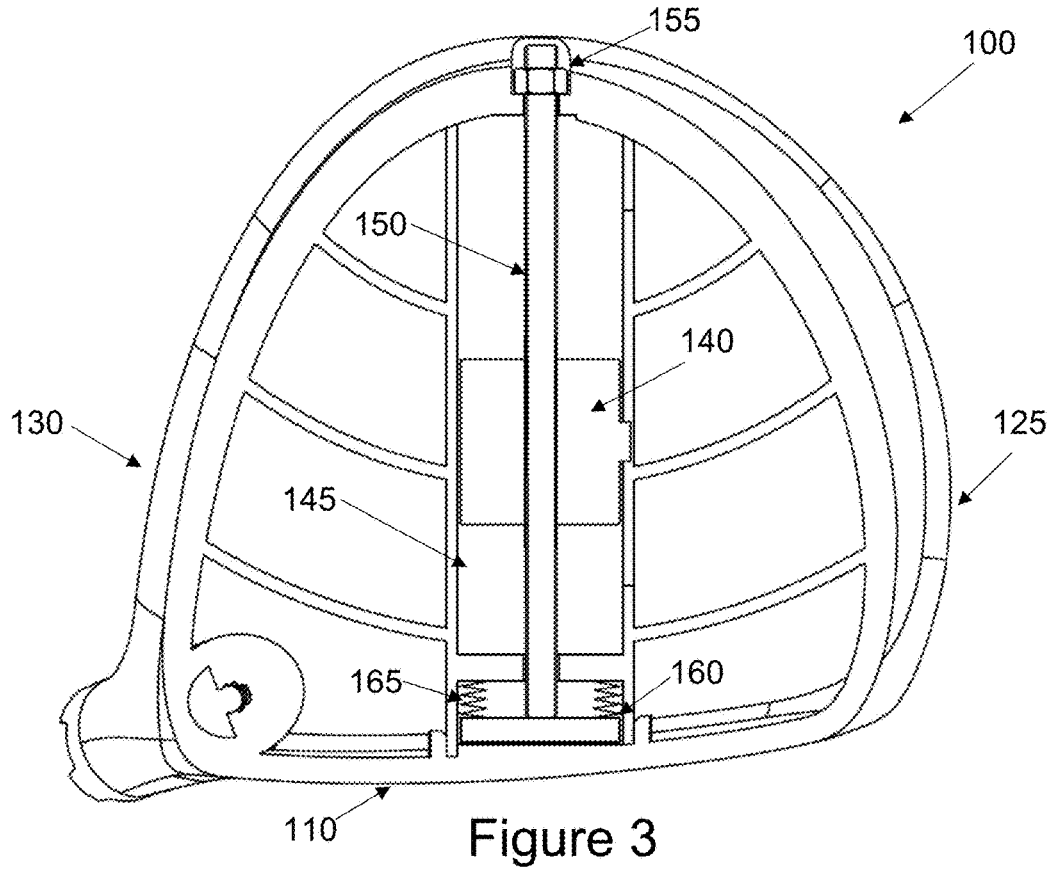
FIG. 3 illustrates a bottom cut-away view of the golf club head of the golf club of FIG. 1, according to an embodiment of the present invention.
Figure 4:
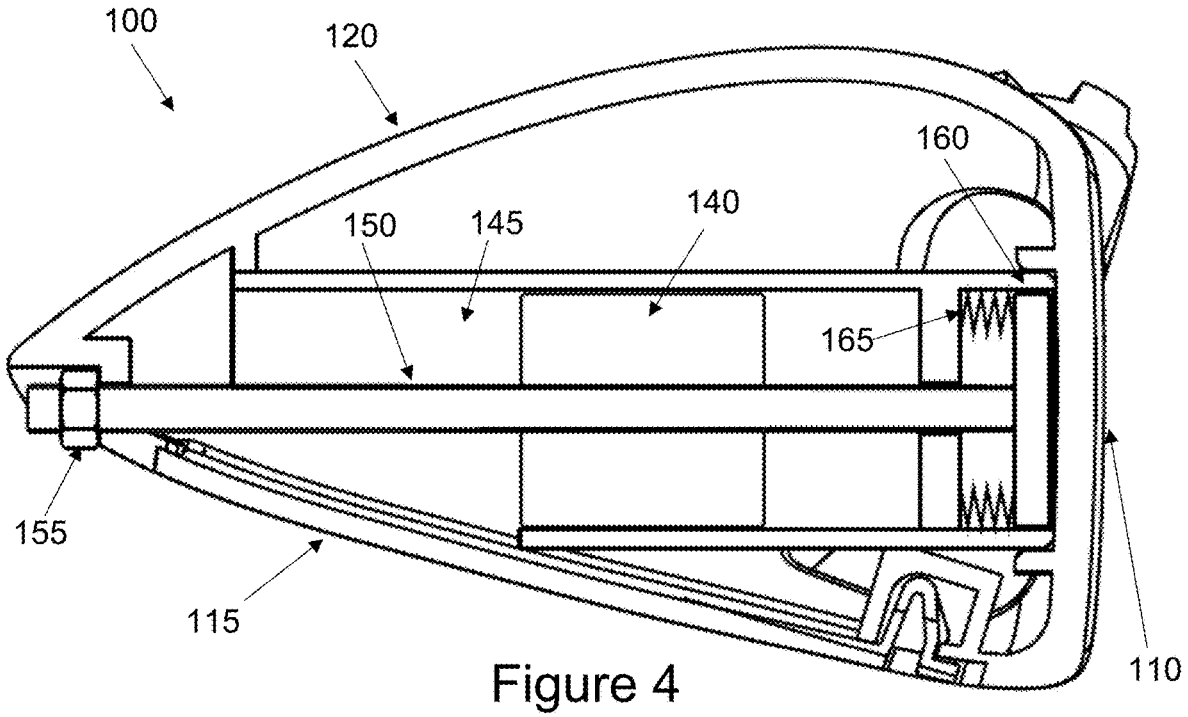
FIG. 4 illustrates a side cut-away view of the golf club head of FIG. 1.

FIG. 3 illustrates a bottom cut-away view of the golf club head 100 of a golf club, according to an embodiment of the present invention, and FIG. 4 illustrates a side cut-away view of the golf club head 100. The golf club head 100 is adjustable and enables a golfer to adjust a weight and balance of the golf club head.

As the dimples 105 significantly reduce drag on the golf club head 100, flex in the shaft of the golf club is significantly reduced. This in turn changes the angle of attack of the golf club head 100, which in turn influences the trajectory of the golf ball.

The level of flex in a traditional golf club changes depending on swing speed, and as such, the change in flex caused by the reduction in drag depends on the swing speed and thus the golfer. As such, an adjustable weight 140 is provided in the club head 110, to allow golfers to compensate for such changes, and according to their particular situation.

The golf club head 100 includes an elongate cylindrical chamber 145, which extends in a direction from a front to a rear of the golf club head 100, behind and perpendicular to a face 110 of the club head 100, and in particular a central striking portion thereof (commonly referred to as the "sweet spot").

The cylindrical chamber 145 includes a threaded rod 150, which extends along a length of the cylindrical chamber 145, through the moveable weight 140. The movable weight 140 includes an internal thread which engages with a thread of the threaded rod 150. As such, when the threaded rod 150 is rotated, the movable weight 140 moves backwards or forwards in the cylindrical chamber 140, thereby changing a balance of the golf club without changing a weight of the golf club.

An outer end of the threaded rod 150 includes a hexagonal head 155, which enables rotation of the rod 150 using a tool. The head 155 may include a thin rubber seal to protect it, prevent ingress of water, and/or to conceal the head 155.

When swung, centrifugal force at the head causes the shaft to flex depending on a position of the weight 140. When the weight 140 is at a rear of the club, the centrifugal force pushes outwardly (downwardly) on a rear of the club head 100, thereby increasing an angle of the face 110 in an upward direction. When the weight 140 is near a front of the head 100, such effect is minimised, as the weight is near the lower end of the shaft. The angle of the face influences the trajectory of the golf ball.

A non-adjustable weight 160 is located immediately behind the central striking portion of the face 110, and held against a rear of the face 110 by a biasing member in the form of a spring 165.

The weight 160 is slightly smaller than the cylindrical chamber 145, and is able to move backwards and forwards slightly within the chamber 145. The weight 160 provides an additional force to the back of the face 110, and also creates a "ping" sound, which is useful for golfers in identifying that the ball has hit the face 110 at the sweet spot. In particular, a micro-second recoil creates a greater force to the back of the face 110, and creates a noise at the same time. The rebound effect of the weight 160 may provide extra force to the ball, resulting in extra distance.

The weight 160 may be able move anywhere from between a fraction of a millimetre within the chamber 145, up to several millimetres (e.g. up to 5 mm).

The weights 140, 160 are cylindrical to match an inner shape of the cylindrical chamber 145. While the weights 140, 160 are illustrated as substantially solid discs, in other embodiments the front of the weight 160 may be hollowed out, and the weights 140, 160 may include hollows or apertures.

In other embodiments, the chamber 145 and weights 140, 160 may be elliptical in cross section, to provide a weight that extends either side of the central striking portion (sweet spot), which is particularly useful for golfers that do not hit the with the sweet spot all of the time.

In some embodiments, the weights may comprise a central cylinder, with adjacent side cylinders adjoined thereto. The central cylinder may be larger than the side cylinders and aligned with the central striking portion, whereas the side cylinders provided on either side of the striking portion. The use of central cylinder, with adjacent side cylinders may comprise less weight than a correspondingly sized elliptical weight.

In an alternative embodiment, the golf club head may include a plurality of elongate chambers, each with a moveable weight and a threaded rod, similar or identical to the chamber 145. The chambers may be arranged in different directions. For example, one or more chambers may extend in a direction transverse to the chamber 145. In particular, first and second chambers may be located on either side of the chamber 145.

Figure 5:
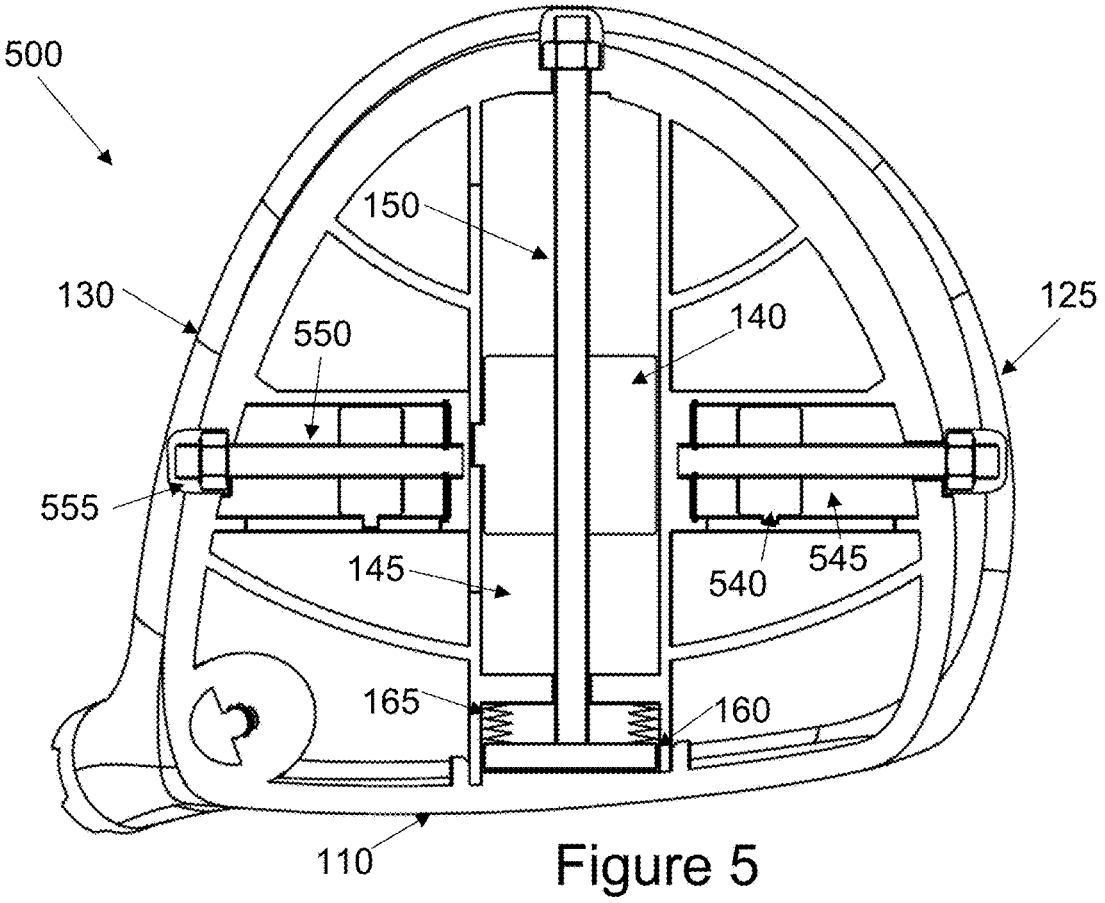
FIG. 5 illustrates a bottom cut-away view of a golf club head of a golf club, according to an alternative embodiment of the present invention.

FIG. 5 illustrates a bottom cut-away view of a golf club head 500 of a golf club, according to an alternative embodiment of the present invention. The golf club head 100 is adjustable in two directions and enables a golfer to adjust a weight and balance of the golf club head in both front to rear and side directions.

In addition to the cylindrical chamber 145 and movable weight 140, the head 500 includes first and second lateral chambers 545, extending from a central portion of the head 500 to the toe 125 and heel 130 respectively. Each of the first and second lateral chambers 545 includes a threaded rod 550 and a weight 540, which functions much like the weight 140 in the chamber 145, but wherein the weights 540 instead move laterally.

When heads 555 are rotated, the threaded rods 550 rotate, thereby causing movable weights 540 to move laterally in the cylindrical chambers 545, thereby changing a balance of the golf club without changing a weight of the golf club. Each of the weights 540 may be adjusted independently, thereby enabling the club to be balanced in multiple directions.

The chambers may be formed together as a single unit, for positioning inside a shell defining the golf club. Such configuration may simplify the manufacturing process of the golf club head 500, as it enables such adjustment to be incorporated relatively easily into existing manufacturing systems.

While the above embodiments illustrate dimples on large portions of the club face 110 and head 100, in other embodiments, channels are defined in the club head, which direct air. The channels include dimples, which create regions of low drag, which assist in directing the club.

Figure 6:
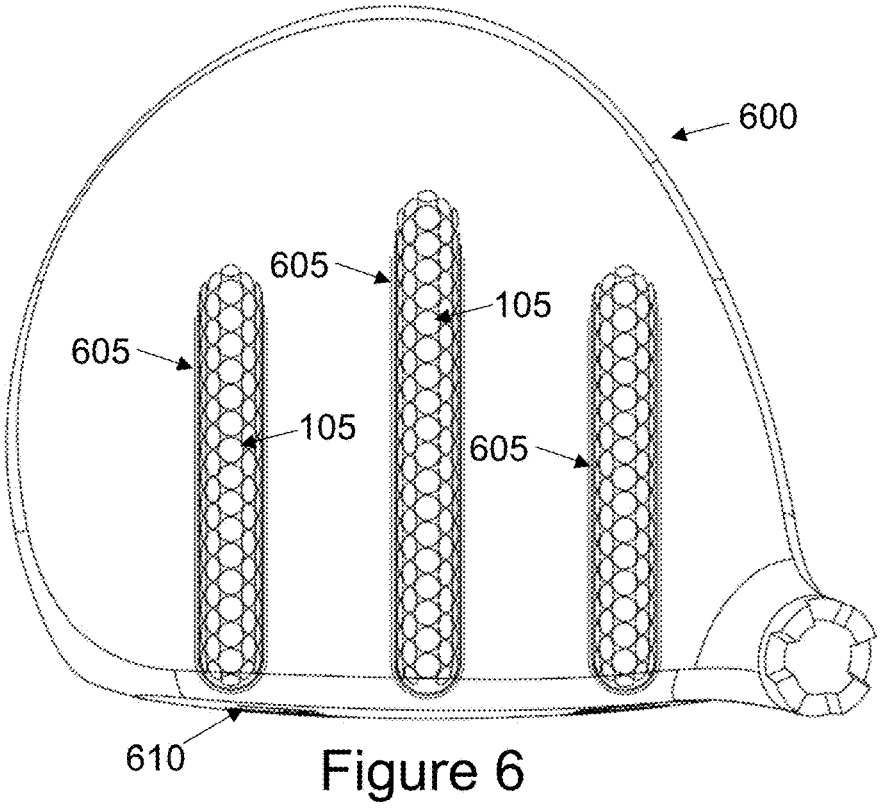
FIG. 6 illustrates a top view of a head of a golf club, according to an embodiment of the present invention.
Figure 7:
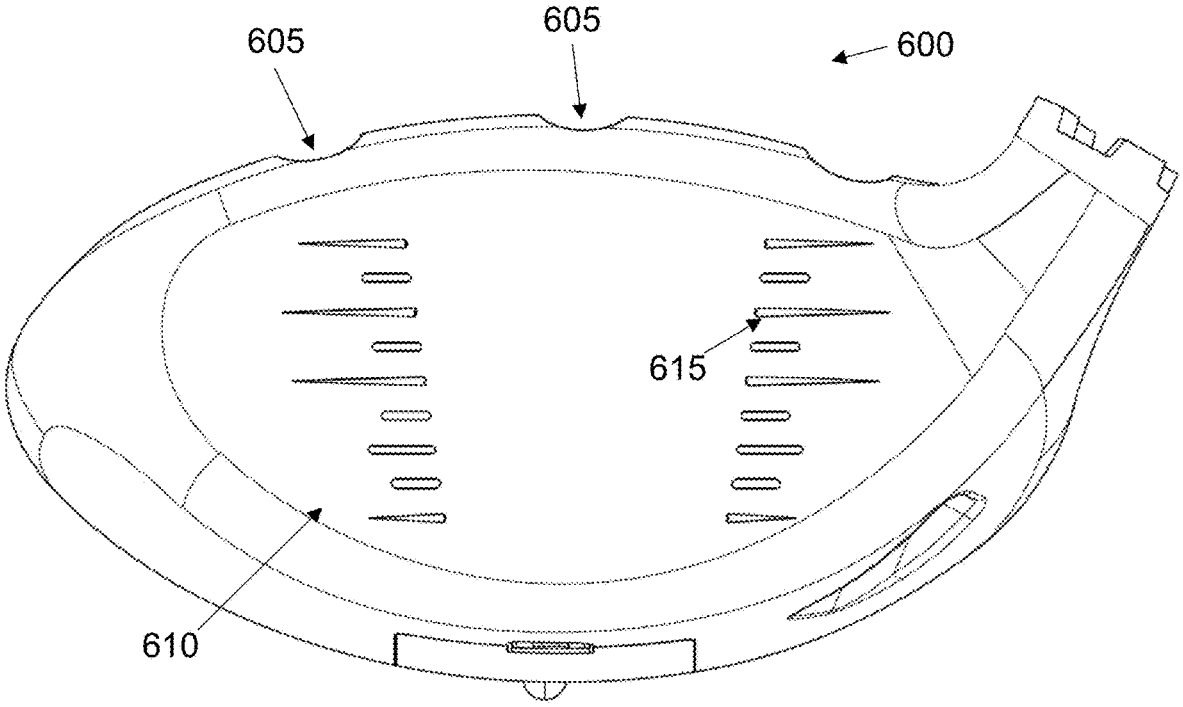
FIG. 7 illustrates a front view of the head of the golf club of FIG. 6, according to an embodiment of the present invention.

FIG. 6 illustrates a top view of a head 600 of a golf club, and FIG. 7 illustrates a front view of the head 600 of the golf club, according to an embodiment of the present invention.

The head 600 includes a plurality of channels 605 that extend in a direction from a front to a rear of the golf club head 600, behind and perpendicular to a face 610 of the club head 600. The channels 605 each include dimples 105 extending along a length of the channels 605, creating regions of low drag, which assist in directing the club. The dimpled channel may give a more controlled movement through the air and helps control the direction of the club head.

In particular, the channels 605 guide air with low drag from a front to a rear of the club. When the club is swung on an angle, the channels help guide the club head 600 back "straight", thereby assisting the golfer in improving their swing.

The channels 605 are between about 0.5 mm and 5 mm deep, and include dimples along a length thereof, that have a depth that is a fraction of that of the depth of the channel 605.

The striking face 610 includes a plurality of parallel grooves 615 machined or cast into the striking face 610. Dimples 105 may be positioned between adjacent grooves 605, and form rows of dimples that are parallel with the grooves, to further assist with aerodynamics of the club head 600.

The club head 600 may include internal weights similar or identical to the weights of the head 100 or the head 500. A centrally located internal weight and a central channel with dimples (on the crown or sole) helps control a direction of the club head (i.e. provide a more controlled swing). Furthermore, the centrally located weight, being directly behind the sweet spot, in combination with the decreased drag of the head, results in greater power and greater ball distance.

In other embodiments, channels including dimples may be defined in the club head having different shapes.

Figure 8:
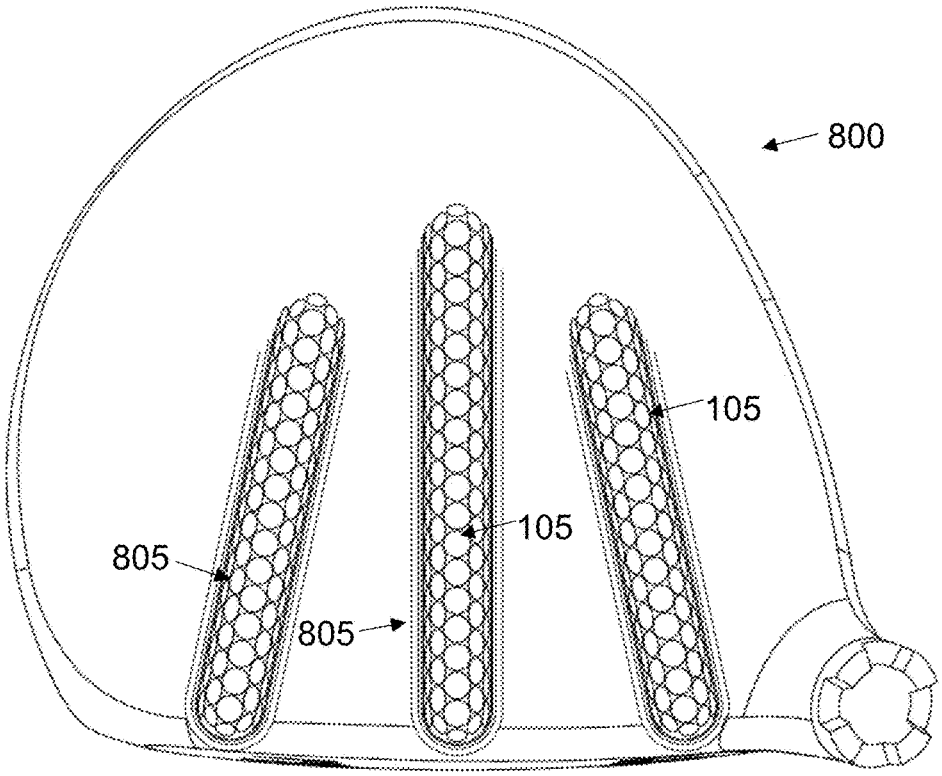
FIG. 8 illustrates a top view of a head of a golf club, according to an embodiment of the present invention.

FIG. 8 illustrates a top view of a head 800 of a golf club, according to an embodiment of the present invention.

The head 800 is similar to the head 600, but wherein channels 805 are all directed towards a point at or near the rear of the club head 800. Such configuration may be useful at guiding air towards a point at the rear of the club, to thereby reduce overall drag associated with the club head 800.

Figure 9:
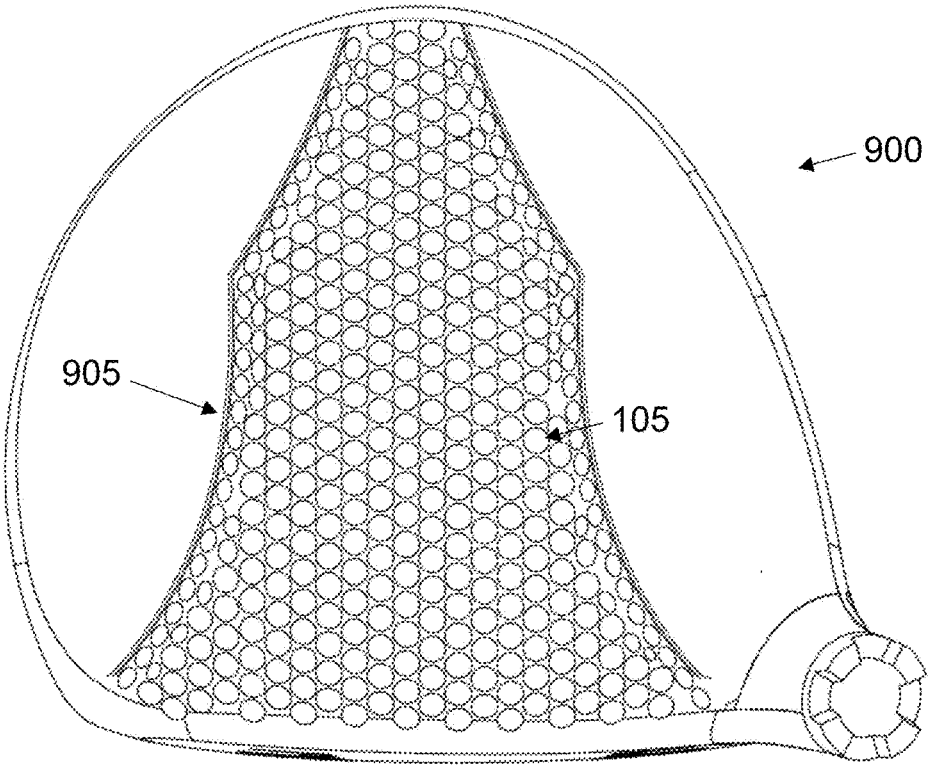
FIG. 9 illustrates a top view of a head of a golf club, according to an embodiment of the present invention.

FIG. 9 illustrates a top view of a head 900 of a golf club, according to an embodiment of the present invention.

The head 900 is similar to the head 800, but wherein a single channels 905, which is tapered, directs air towards a point at or near the rear of the club head 900.

Figure 10:
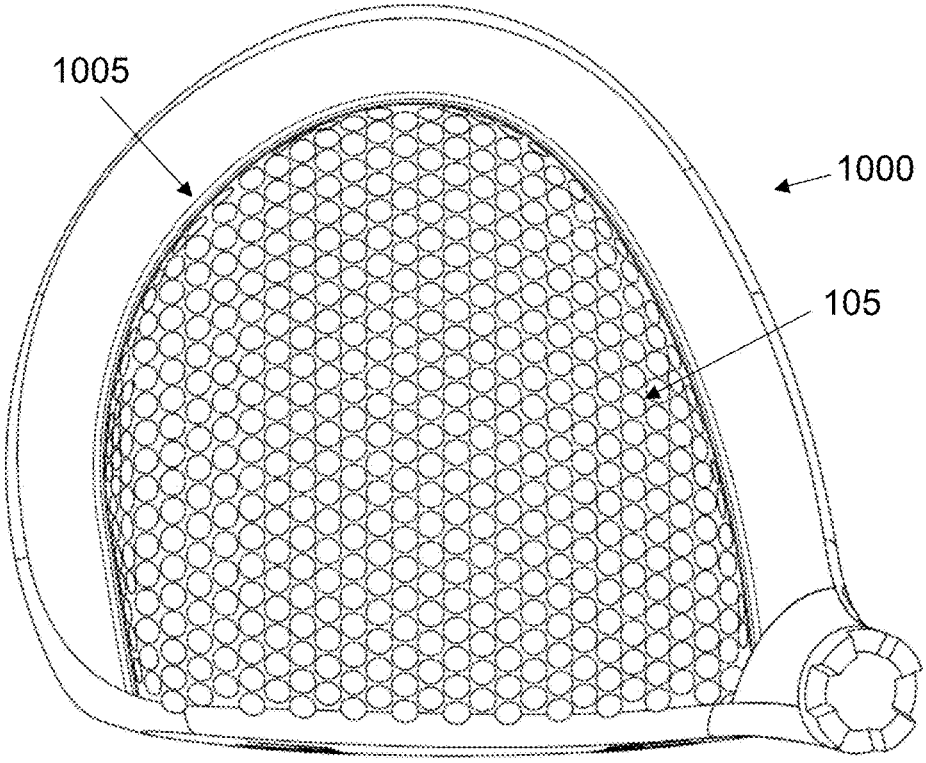
FIG. 10 illustrates a top view of a head of a golf club, according to an embodiment of the present invention.
Figure 11:
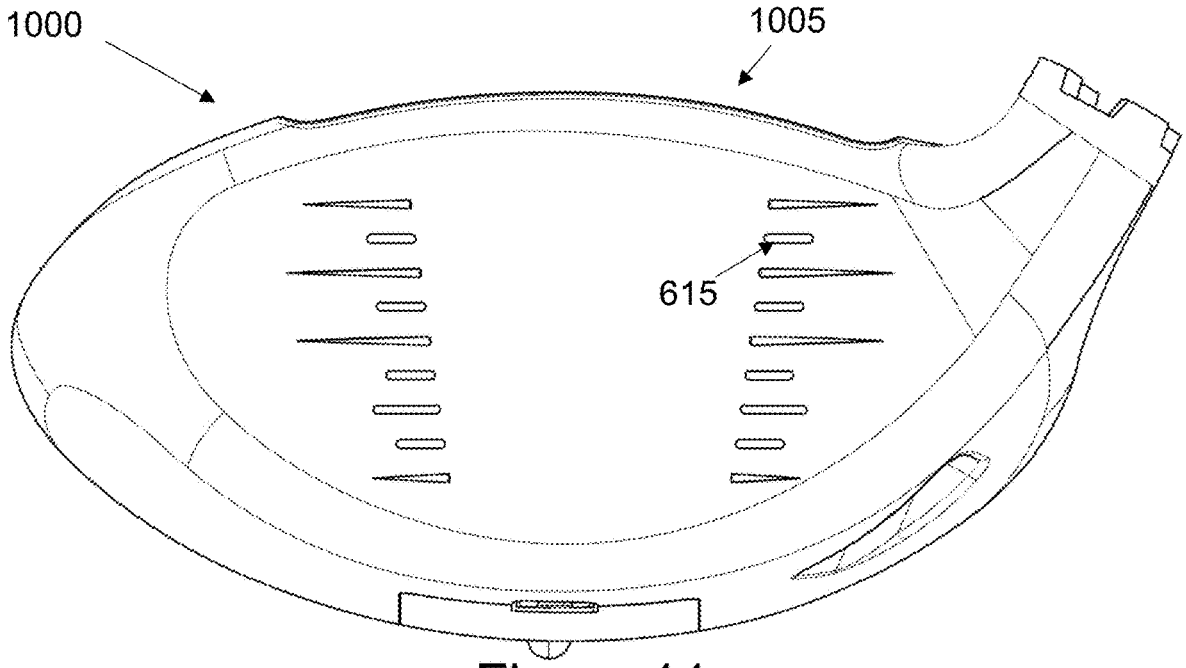
FIG. 11 illustrates a front view of the head of FIG. 10.

FIG. 10 illustrates a top view of a head 1000 of a golf club, according to an embodiment of the present invention. FIG. 11 illustrates a front view of the head 1000.

The head 1000 is similar to the head 900, but wherein a single channel 1005 extends over much of the crown of the club head 1000. The channel 1005 has a base that is curved in shape.

Figure 12:
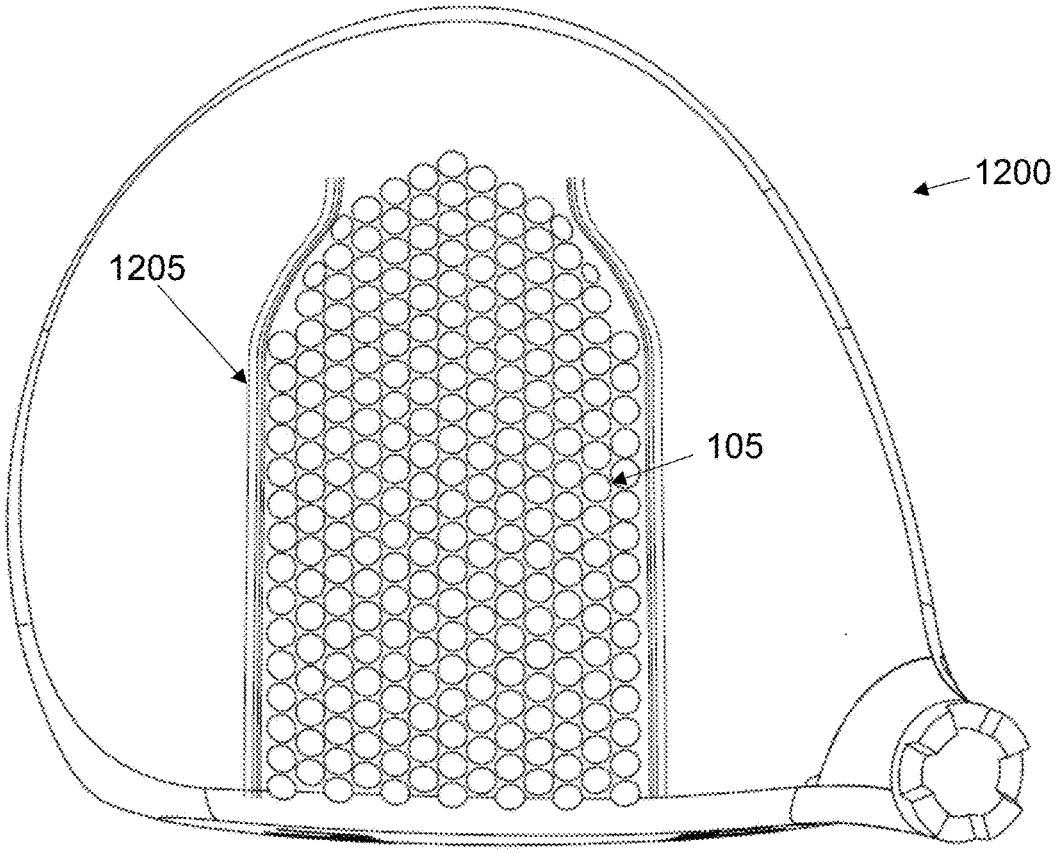
FIG. 12 illustrates a top view of a head of a golf club, according to an embodiment of the present invention.

FIG. 12 illustrates a top view of a head 1200 of a golf club, according to an embodiment of the present invention.

The head 1200 is similar to the head 900, but wherein a channel 1205 is substantially uniform in width initially, but is tapered at a rear of the club head 1200.

Figure 13:
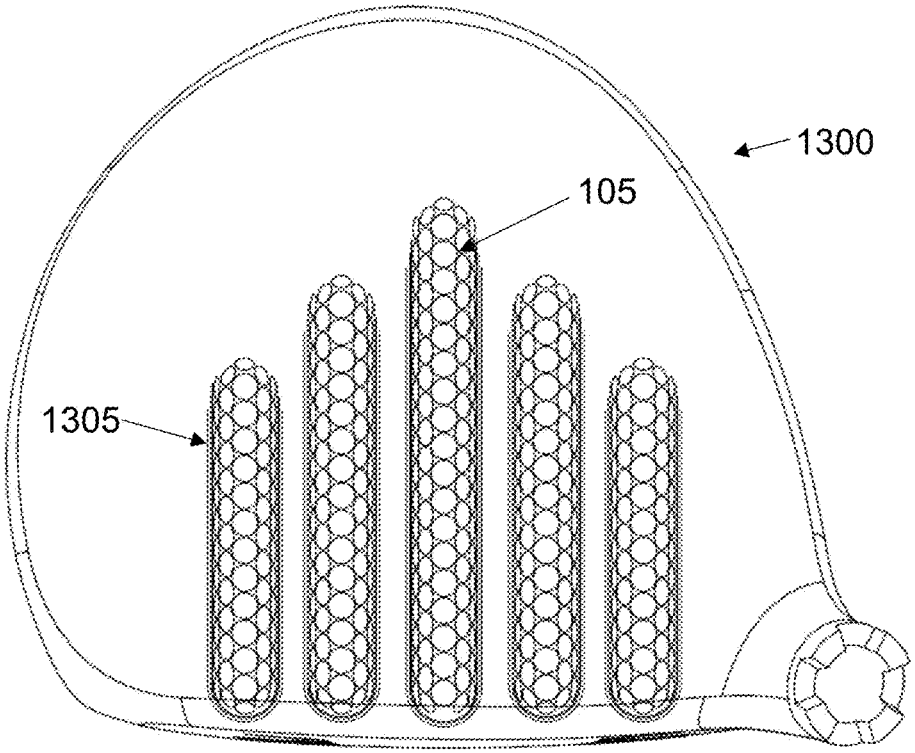
FIG. 13 illustrates a top view of a head of a golf club, according to an embodiment of the present invention.
Figure 14:
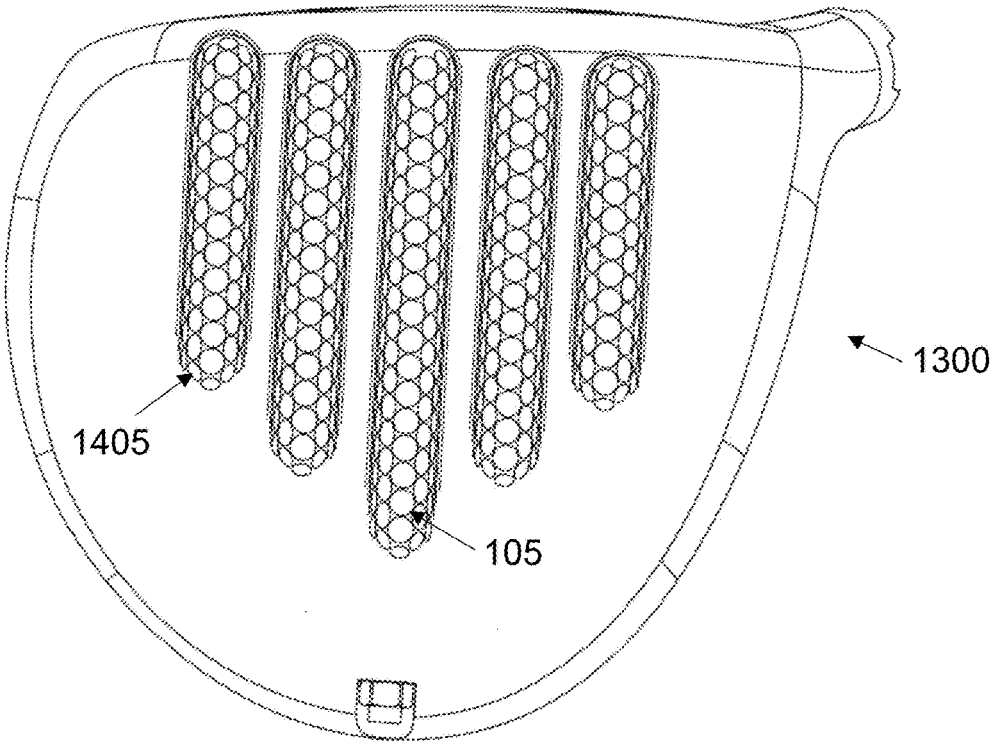
FIG. 14 illustrates a bottom view of the head of FIG. 13.

FIG. 13 illustrates a top view of a head 1300 of a golf club, according to an embodiment of the present invention. FIG. 14 illustrates a bottom view of the head 1300.

The head 1300 is similar to the head 600 but include five parallel channels 1305 on a crown of the head. Five parallel channels 1405 are also provided on a sole of the head 1300.

Figure 15:
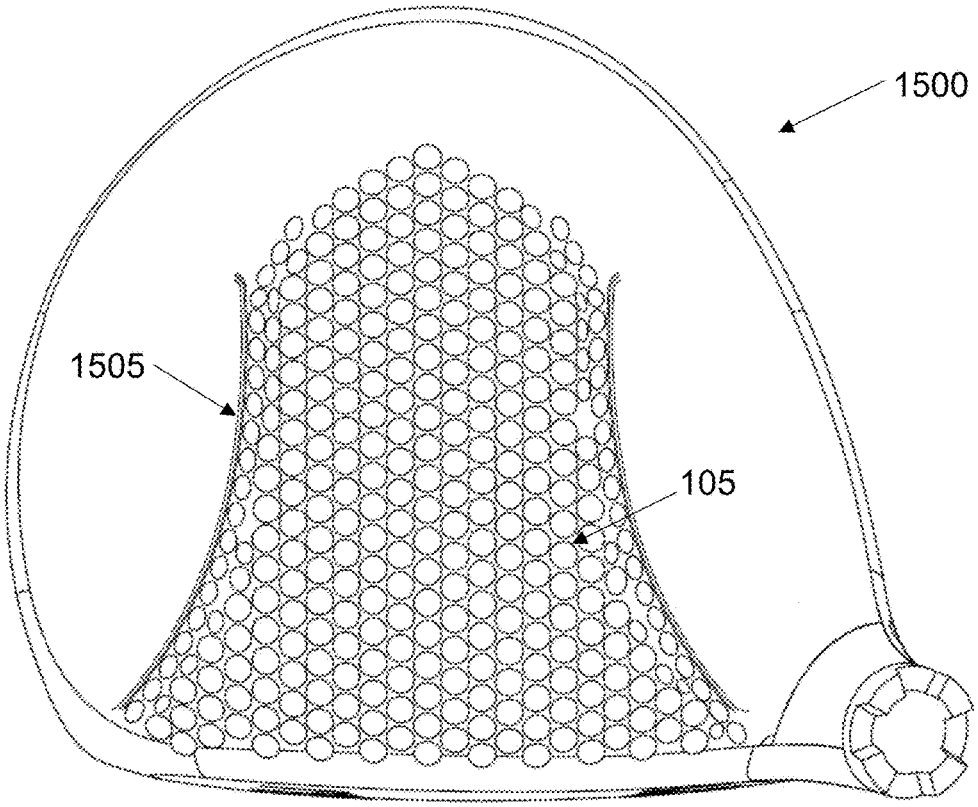
FIG. 15 illustrates a top view of a head of a golf club, according to an embodiment of the present invention.
Figure 16:
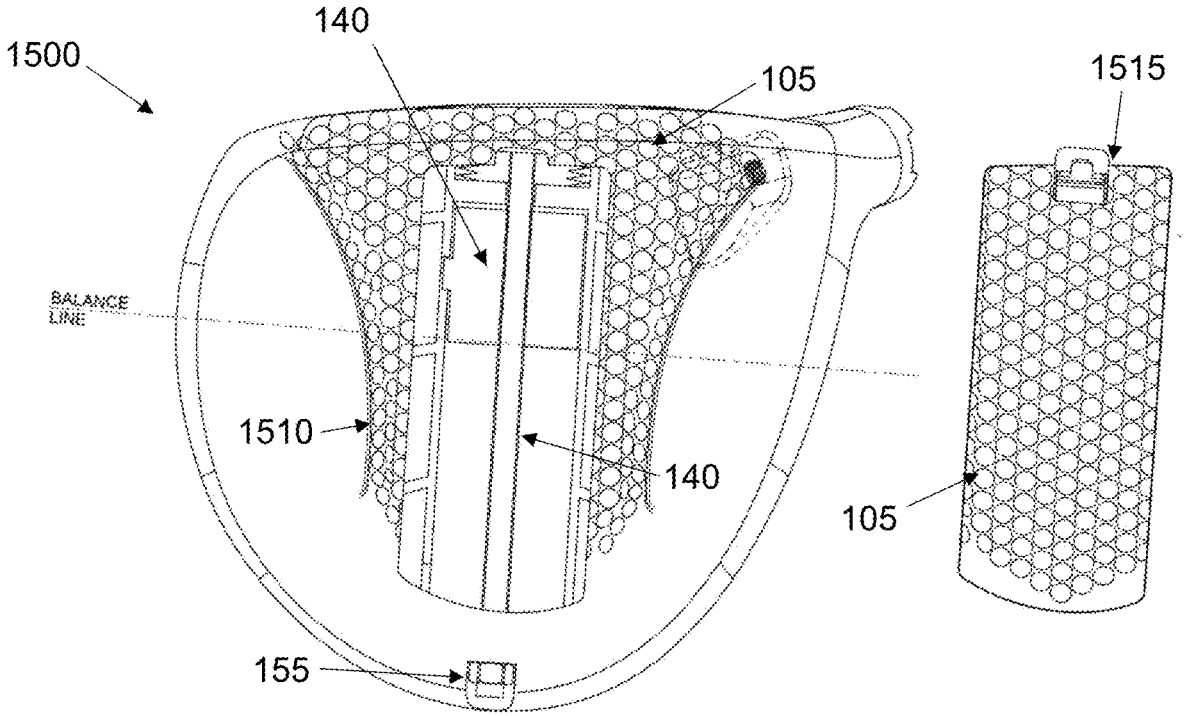
FIG. 16 illustrates a bottom view of the head of FIG. 15, illustrating a weight in a forward position.

FIG. 15 illustrates a top view of a head 1500 of a golf club, according to an embodiment of the present invention. FIG. 16 illustrates a bottom view of the head 1500.

The head 1500 includes tapered channels 1505, 1510 on a crown and sole of the club head, and the internal weight mechanism of the head 100. The head 1500 includes a removeable cover 1515 (removed in FIG. 16), which provides access to the internal weight mechanism. Such configuration may enable the weight 140 to be removed and replaced by a smaller or larger weight, for example.

Figure 17:
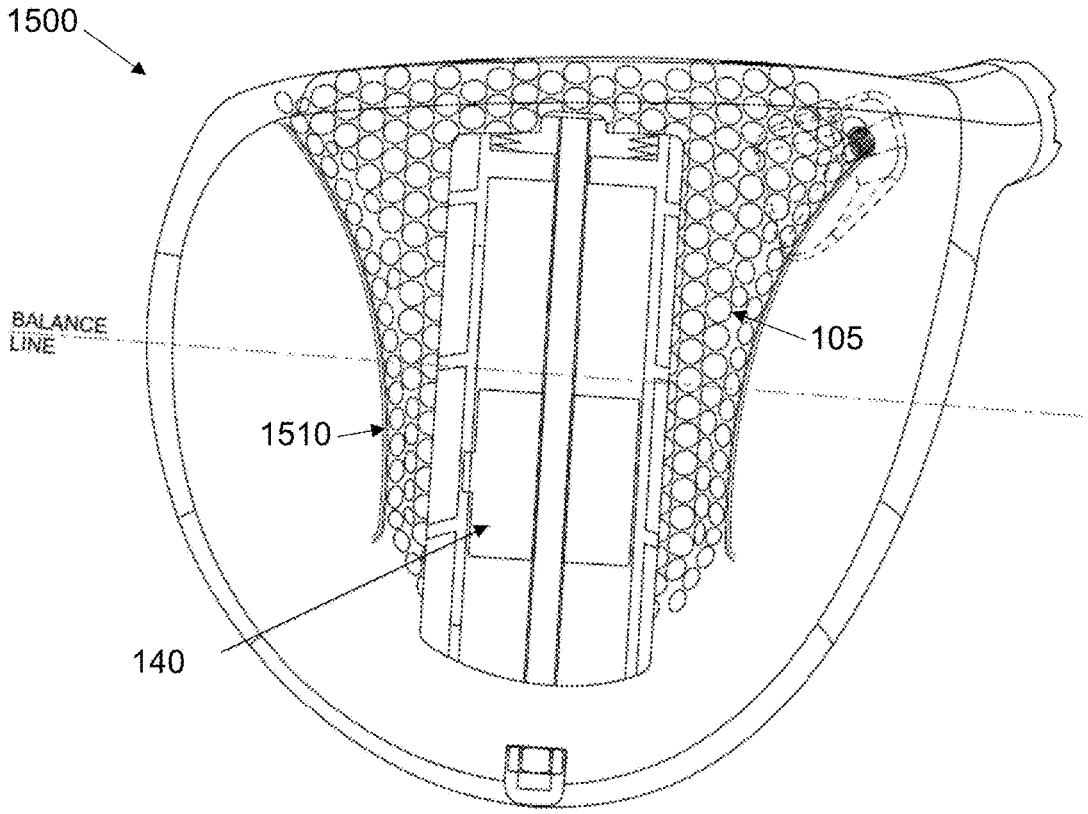
FIG. 17 illustrates a bottom view of the head of FIG. 15, illustrating a weight in a rearward position.

As shown in FIG. 16, when fully forward, the weight 140 is forward of the balance line of the club head 1500. When moved to a rear of the club head 1500, as illustrated in FIG. 17, the weight 140 is fully behind (to a rear of) the balance line.

As such, the balance of the club head 1500 can be changed significantly by moving the weight 140, and thereby the angle of attack of the golf club when swung. This in turn change the angle of the face of the club when it hits the golf ball, thereby influencing the shot.

Various methods of attaching the weight and cylinder to the inside of the club head may be used. In some embodiments, the weight assembly may be inserted into the head through an open face thereof. Preferably, the internal weight mechanism is configured to not significantly alter the expansion characteristics of the club head when hitting the ball. In particular, a golf club head will generally expand laterally when hitting a golf ball, which in turn will add additional speed to the golf ball when re-shaping.

Figure 18:
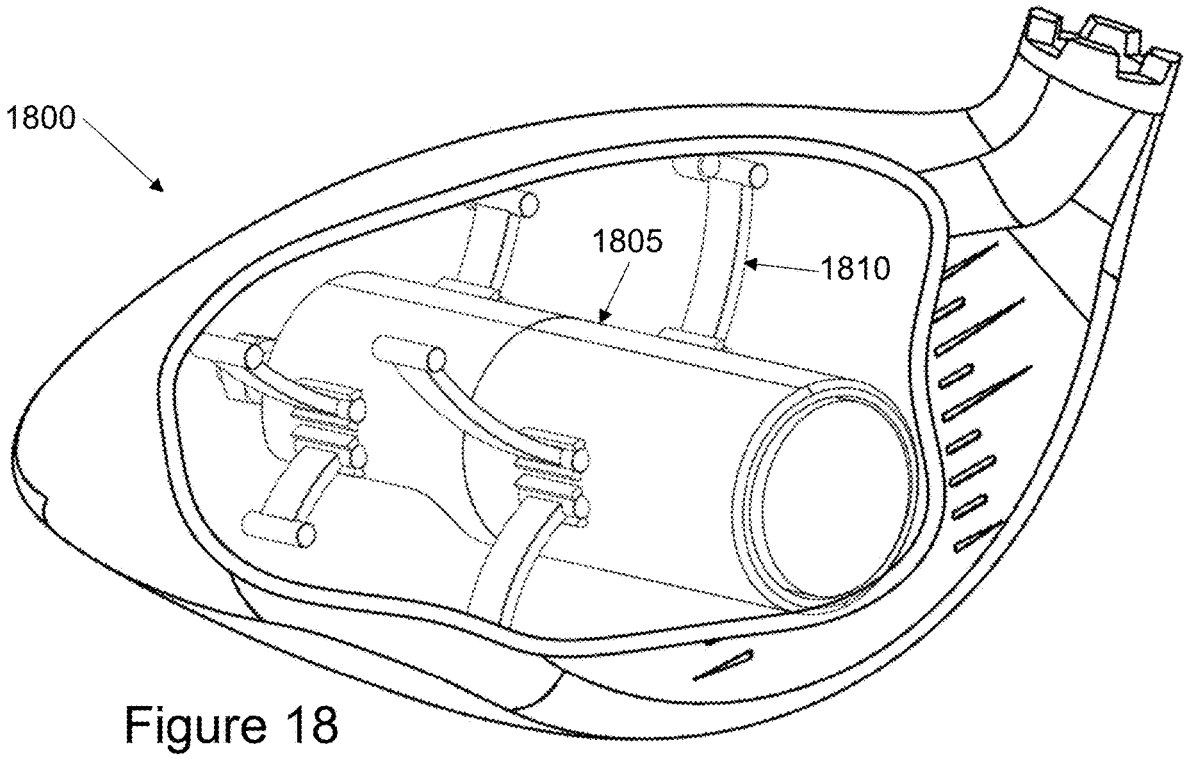
FIG. 18 illustrates a cut-away perspective view of a head of a golf club, according to an embodiment of the present invention.

FIG. 18 illustrates a cut-away perspective view of a head 1800 of a golf club, according to an embodiment of the present invention.

The golf club head 1800 includes an elongate cylindrical chamber 1805, which extends in a direction from a front to a rear of the golf club head 1800, behind and perpendicular to a face of the club head 1800, and in particular the "sweet spot".

The chamber 1805 houses a weight, similar or identical to the weight 140, which may move back and forwards within the chamber to adjust a balance of the head 1800.

The chamber 1805 is supported by a plurality of legs 1810, which extend outwardly from the chamber 1805, perpendicular to an axis of the chamber 1805, and engage with an inner wall of the club head 1800.

Figure 19:
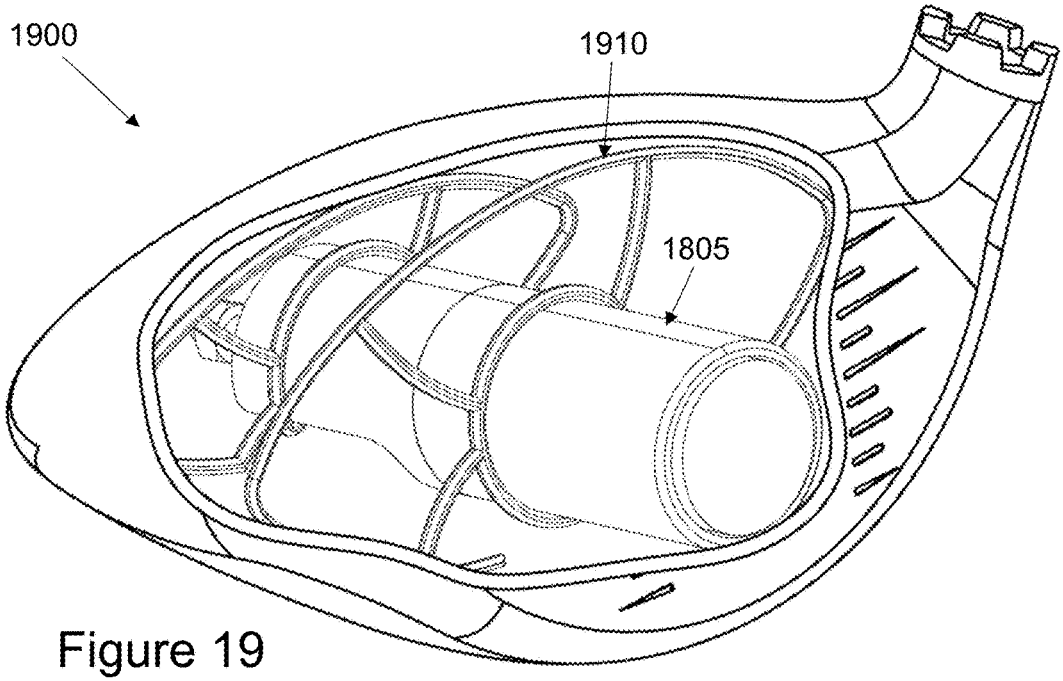
FIG. 19 illustrates a cut-away perspective view of a head of a golf club, according to an embodiment of the present invention.

FIG. 19 illustrates a cut-away perspective view of a head 1900 of a golf club, according to an embodiment of the present invention. The head 1900 is similar to the head 1800, but wherein the chamber 1805 is supported by a framework 1910, which includes an inner portion, that encases the chamber 1805, an outer portion, which is supported against an inner wall of the club head 1800, and arms extending therebetween.

The internal weight mechanisms described above may be used together with any of the dimpled and/or channel arrangements described above.

Figure 20:
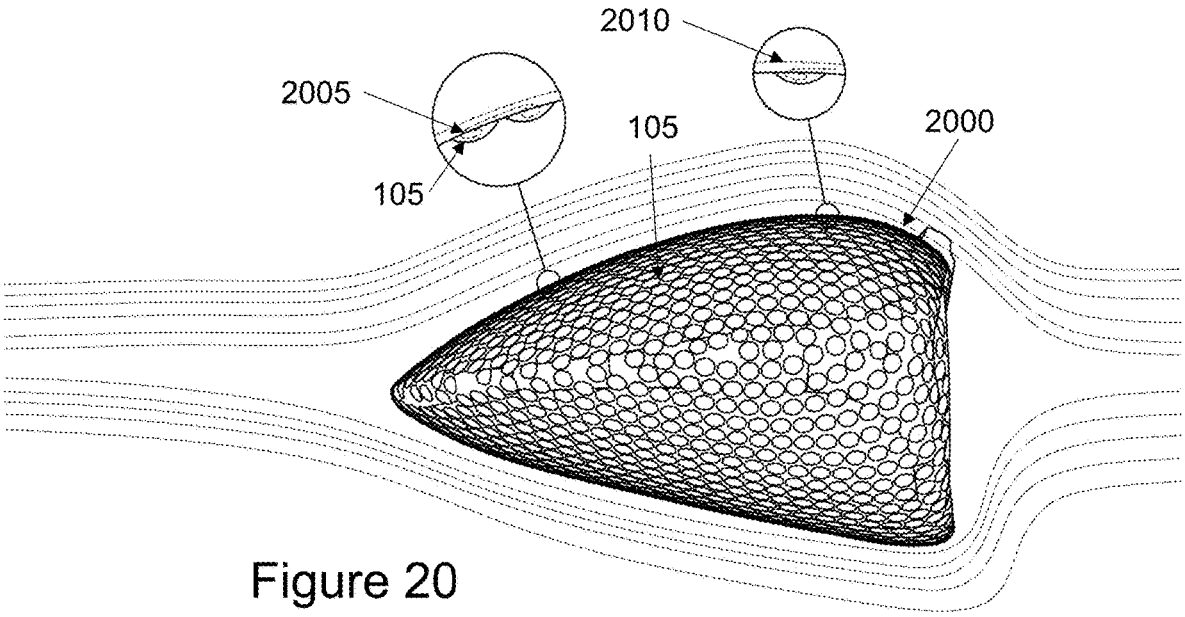
FIG. 20 illustrates a golf club head including dimples on its entire surface, to illustrate how the dimples improve aerodynamics of golf clubs.

As outlined above, the dimples 105 improve aerodynamics of the golf club head. FIG. 20 illustrates a golf club head 2000 including dimples 105 on its entire surface, to illustrate how the dimples improve aerodynamics of golf clubs. While the head 2000 has dimples on its entire surface, the aerodynamic features may be applied to the case where dimples are only on part of the club head.

The dimples 105 create a boundary layer of turbulent air immediately adjacent to the dimples 105, as illustrated by arrows 2005, above which smoothly flowing air may travel, as illustrated by arrow 2010. Such configuration decreases the size of a wake region behind the golf club head 100 when swung, thereby reducing drag.

In other configurations and/or situations, the air may roll across the dimples, such that the air flows in a smooth undulating pattern. In such case, the speed may exit the dimples at a greater speed (up to twice the speed) as when entering the dimple.

In addition to providing golf club heads including dimples, embodiments of the present invention provide covers which may be used to add dimples to golf club heads post manufacture.

Figure 21:
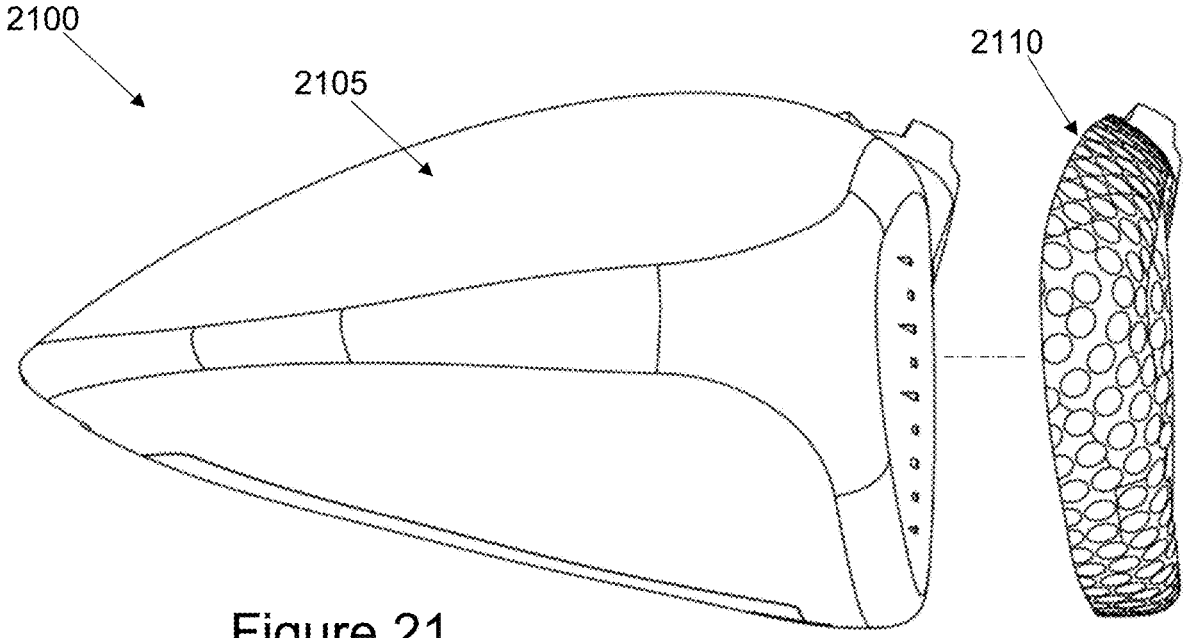
FIG. 21 illustrates an exploded side view of a golf club head including a head portion and a dimpled cover, according to an embodiment of the present invention.
Figure 22:
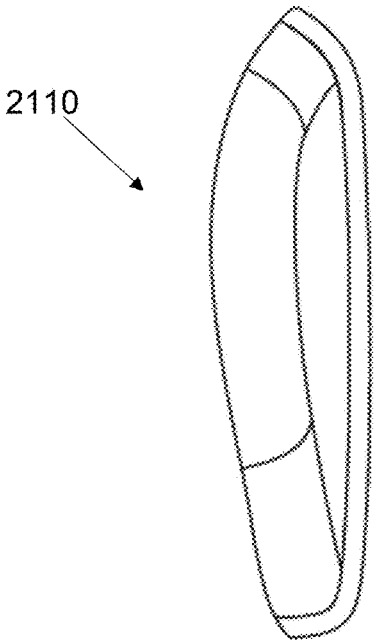
FIG. 22 illustrates a cross sectional view of the dimpled cover of FIG. 21.

FIG. 21 illustrates a partially exploded side view of a golf club head 2100 including a head portion 2105 and a dimpled cover 2110 (illustrated being separated). FIG. 22 illustrates a cross sectional view of the dimpled cover 2110, and FIG. 23 illustrates a front view of the golf club head 2100 with the cover 2110 installed.

The head portion 2105 may comprise a traditional golf club head, and the dimpled cover 2110 may be selectively attached to the front of the golf club head to improve aerodynamics thereof.

The dimpled cover 2110 is thin and conforms to the front of the head 2105, and may be attached by any suitable means including a clip-on means, or by use of adhesives.

Figure 23:
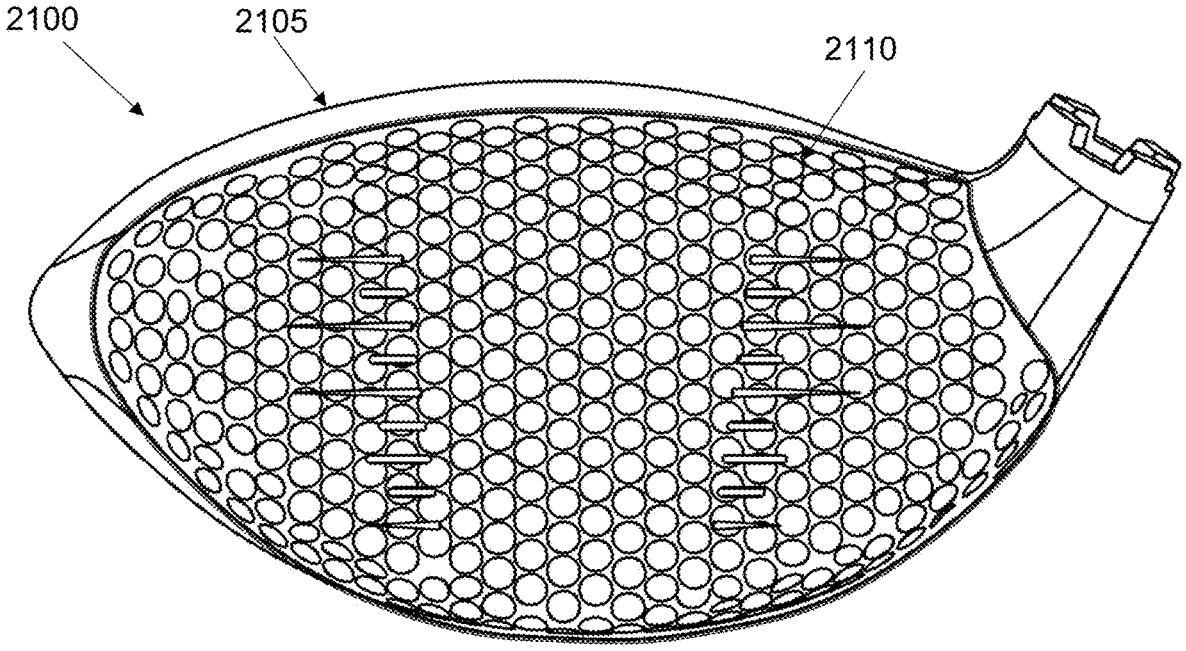
FIG. 23 illustrates a front view of the golf club head of FIG. 21 with the cover installed.

As can be seen from FIG. 23, the dimples are not only on the striking face, but extend onto the crown, sole heel and toe of the club head 2100.

Figure 24:
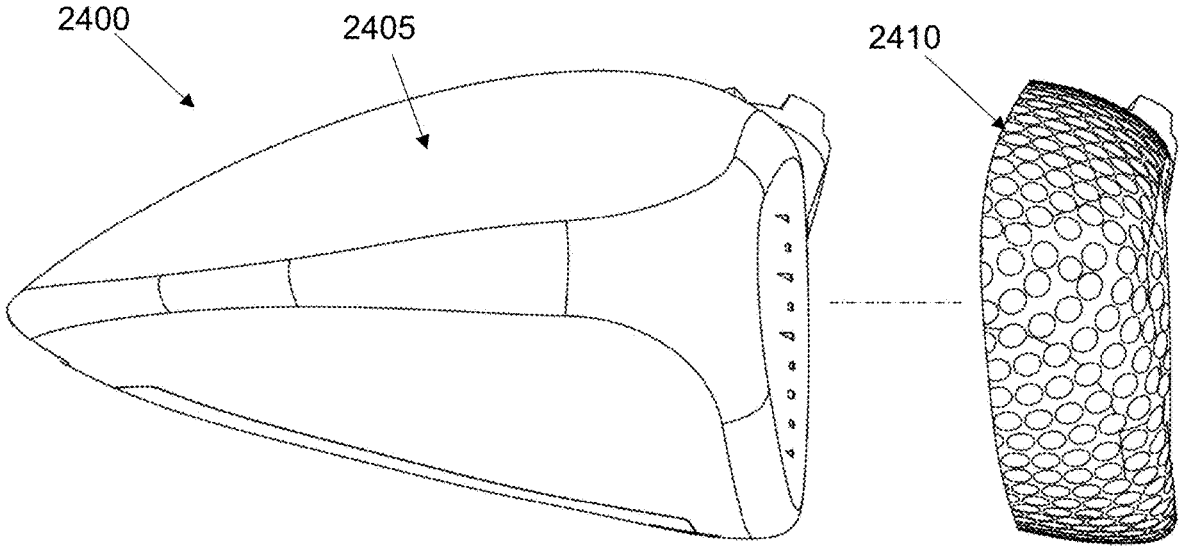
FIG. 24 illustrates a partially exploded side view of a golf club head including a head portion and a dimpled cover separated, according to an embodiment of the present invention.

FIG. 24 illustrates a partially exploded side view of a golf club head 2400 including a head portion 2405 and a dimpled cover 2410 (illustrated being separated). The golf club head 2400 is similar to the club head 2100, but the cover 2410 extends further onto the head. This configuration is useful in providing further aerodynamics to the head 2400.

The golf club heads described above may include first and second dimples 105, which are different in size and/or shape to each other. As an illustrative example, dimples 105 on the striking face 110 may be smaller in depth or diameter than dimples 105 not on the face 110. The dimples on the face 110 may be about 0.04 mm in depth, and the dimples not on the face 110 may be about 0.1 mm in depth.

The dimples 105 may be arranged in rows on the head, the rows being parallel to a sole (or ground line) of the head. The second dimples may be arranged in rows perpendicular to the sole (or ground line), and thus form a matrix of dimples.

In alternative embodiments, the dimples may be integrated in a honeycomb like arrangement, where the dimples are tightly packed onto a surface of the club head, with little or no gaps therebetween. In some cases, the dimples (or edges thereof) may be touching each other.

The dimples 105 are spherical dimples and are configured such that an edge between the face (of the club head) on which the dimple 105 is provided and the dimple 105 itself is about 45 degrees or less.

Various other types of dimple shapes may be used. In some embodiments, the dimples may be configured such that they are directional, rather than axially symmetrical, to encourage the flow of air in a direction corresponding to a swing of the golf club (i.e. from front to rear as the golf club is swung).

The dimples may be sinusoidal in cross section in a plane perpendicular to the face (of the club head). Such configuration removes an edge between the face and the dimple. As such, the dimples do not include any gripping edges, which may reduce the interaction with a golf ball, if provided on the striking face, or alter the characteristics of the boundary layer of turbulent air.

In yet an alternative embodiment, the dimples may be hexagonal dimples.

In some embodiments, hexagonal dimples may be combined with spherical dimples, or dimples of another shape. For example, spherical dimples (or dimples having a circular cross section) may be located on a striking face of the golf club head, whereas hexagonal dimples are located on one or more other surfaces of the head.

The hexagonal dimples may be arranged such that adjacent dimples abut each other in a honeycomb-like arrangement. However, hexagonal dimples may also be spaced, in a similar manner to the spherical dimples 105 outlined above. Similarly, spherical dimples may be arranged in groups of dimples, where smaller and larger dimples are grouped together in triangular sections. In short, any suitable shape and arrangement of dimples may be used.

At least 10% of a surface of the head of the golf club may be covered with dimples. In some embodiments, at least 50% of the surface of the head may be covered with dimples. Substantially an entire surface of the body may be covered with dimples.

While a driver has been explicitly illustrated, the dimples may be provided on any suitable type of golf club.

The golf club heads described above may be formed of metal. The surface features (i.e. dimples or beads) may be cast into the head. Alternatively, the surface features may be machined, pressed, or stamped into the head.

In one embodiment, the golf club head may be formed of multiple pieces of pressed metal. In the case of a driver, each piece may be pressed with dimples and into shape, and micro-welded to form the club head. During such procedure, weights or other components may be added to an inside of the club head. Finally, a small breather hole may be provided to allow hot air to escape during manufacturing. The breather hole may be sealed off post manufacture.

In another embodiment, the golf club head may be 3D printed of metal, a metal alloy, a combination of metal and another material (e.g. polycarbonate), carbon fibre, nylon, or any other suitable material. In such case, the golf club head may be custom printed for a single user, or be mass produced by such 3D printing.

Alternatively, the heads may be formed entirely or in part of other materials. For example, the head may be formed of resin, polycarbonate, composite material, or any other suitable material.

The heads may be unitarily formed. Alternatively, the head may be formed of two or more components. For example, the heads may be formed of metal, having a thin polycarbonate sleeve covering a portion thereof, where at least some of the surface features (e.g. dimples or beads) are located on the polycarbonate sleeve.

The exact number, size, shape and placement of the dimples may vary according to the size and shape of the golf club head, and/or one or more desired characteristics of the golf club. Similarly, the number, size, shape and placement of the dimples or beads may be balanced according to aesthetics of the golf club head. Regardless of number, size, shape and placement, the dimples may be smooth to the touch.

The golf clubs may be USGA compliant. In such case, the dimples may be arranged such that they do not engage with the ball in any significant way. Unlike grooves, punch marks, and the like that are designed to impart spin on the ball, the dimples may be arranged such that they do not grip the ball, and thus do not alter a motion of the ball. As outlined above, this may be achieved by having dimples forming an edge having an angle less than 45 degrees, or by not having any significant edge at all. Similarly, dimples may be positioned parts of the face of the golf club that are generally not in contact with the golf ball in use. As an illustrative example, the sweet spot (or an area around the sweet spot) may be free of dimples.

While golf clubs have been illustrated, the teachings of the present invention may be applied to a number of sporting articles adapted to be swung by a user. Such sporting articles may include a handle and a striking face, configured to strike a ball or other item, and may include improve aerodynamics and/or balance.

As illustrative examples, the sporting articles may comprise a club (e.g. a golf club), a racket (e.g. a tennis squash or badminton racket), a bat (e.g. a baseball bat) or a stick (e.g. a hockey stick). Embodiments of the present invention also include helmets, where dimples are provided on an outer surface of the helmet to improve aerodynamics of the helmet and thereby to reduce drag, while increasing ventilation in the helmet.

Figure 25:
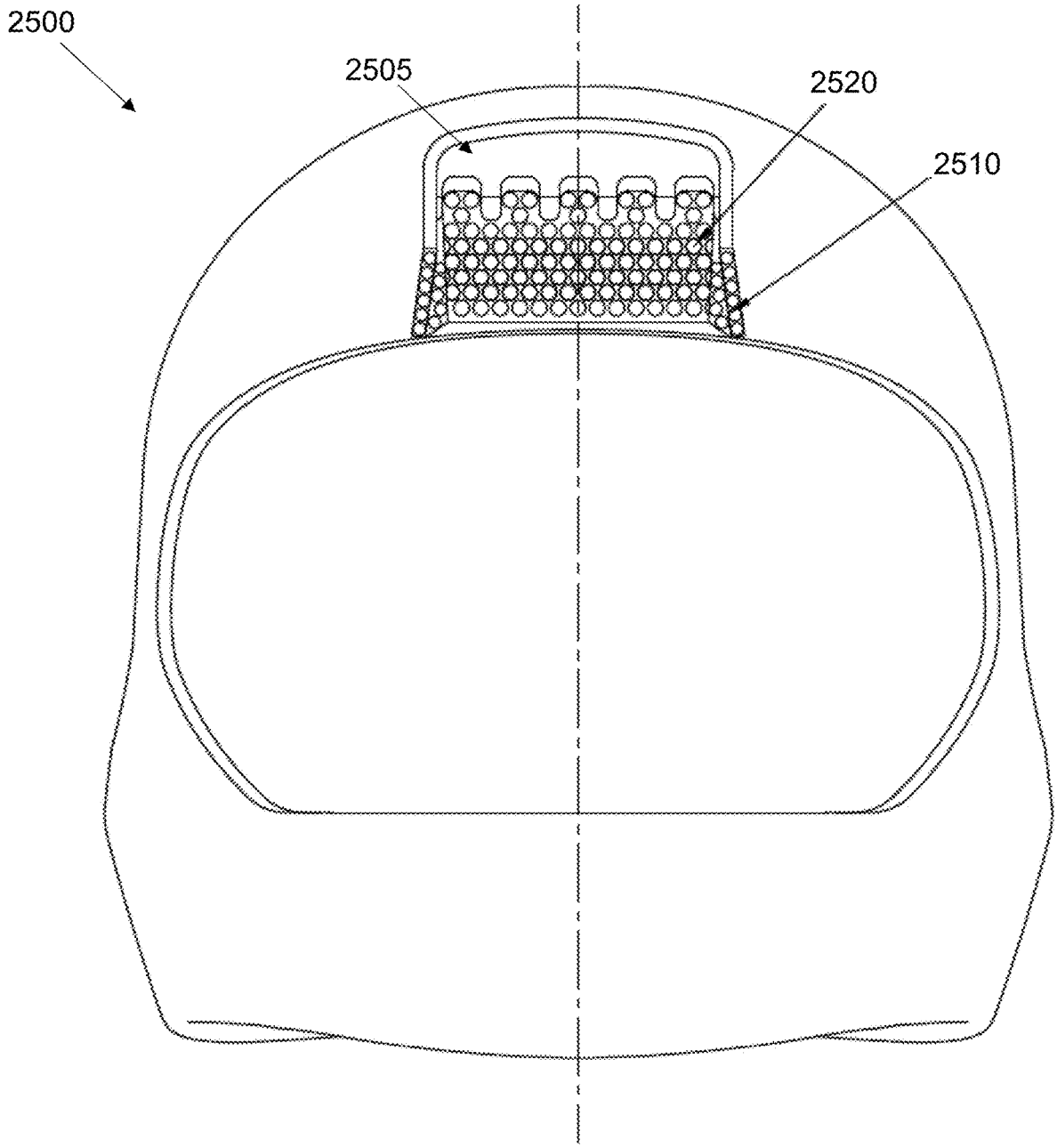
FIG. 25 illustrates a front view of motorcycle helmet, according to an embodiment of the present invention.
Figure 26:
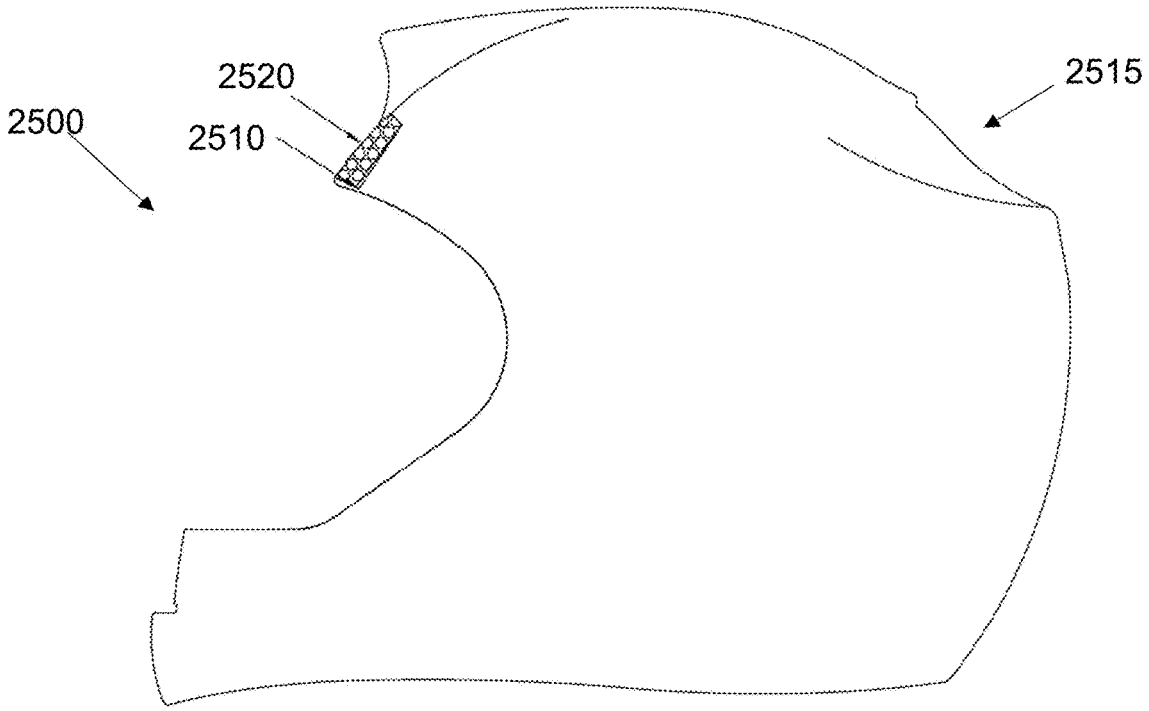
FIG. 26 illustrates a side view of the motorcycle helmet of FIG. 25.
Figure 27:
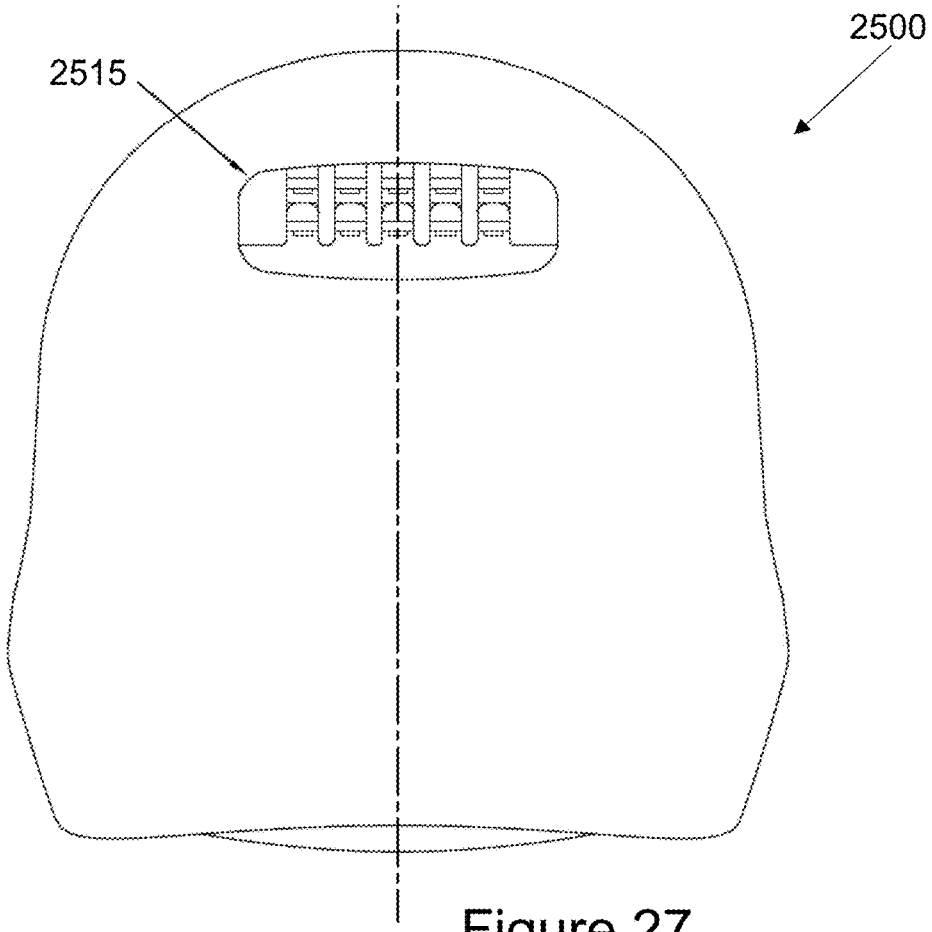
FIG. 27 illustrates a rear view of the motorcycle helmet of FIG. 25.

FIG. 25 illustrates a front view of motorcycle helmet 2500, according to an embodiment of the present invention. FIG. 26 illustrates a side view of the motorcycle helmet 2500, and FIG. 27 illustrates a rear view of the motorcycle helmet 2500. The motorcycle helmet 2500 is shaped much like a conventional motorcycle helmet, but includes a vent mechanism, for ventilating the helmet.

In particular, the helmet 2500 includes a channel 2505 which extends from an opening 2510 at a front of the helmet 2500 to an exit 2515 at a rear of the helmet 2500. The channel 2505 includes a plurality of dimples 2520 on an outer surface of the opening 2510, and through the channel 2505. The dimples 2520 increase airflow through the channel 2505, and thereby increase ventilation through the helmet 2500 by increasing the venturi effect.

Figure 28:
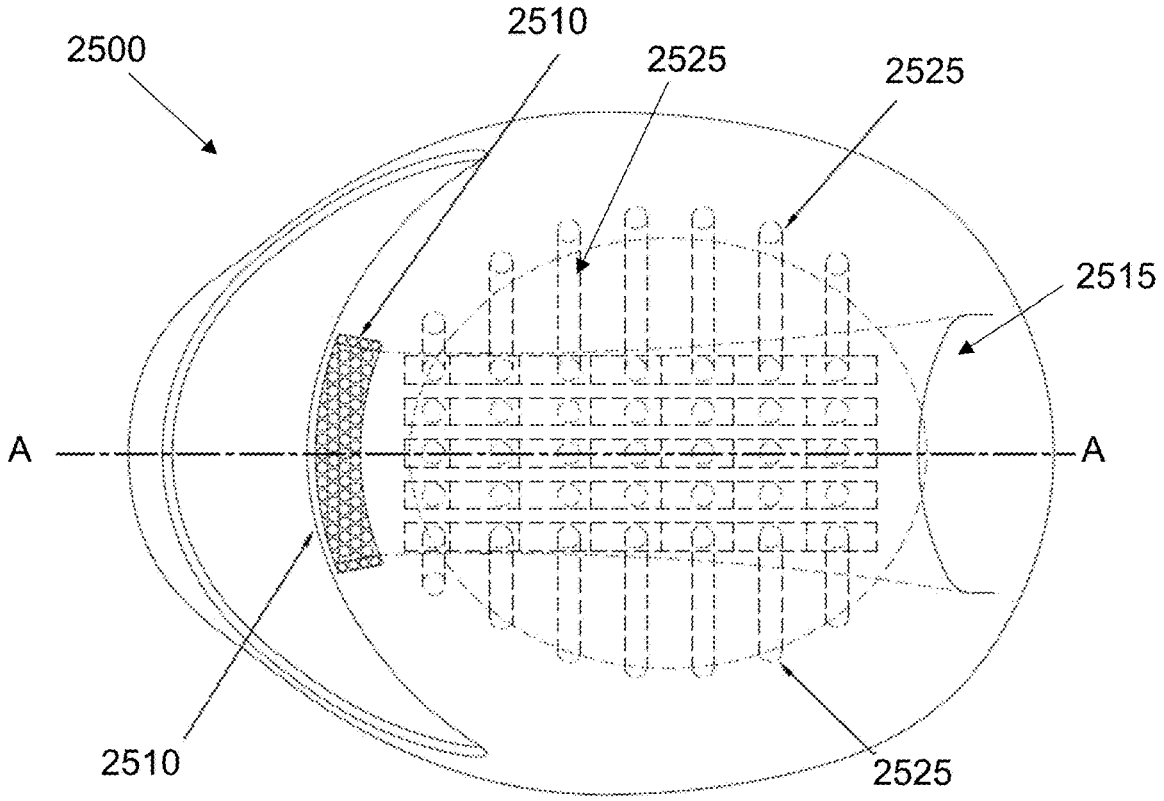
FIG. 28 illustrates a top view of the helmet of FIG. 25.
Figure 29:
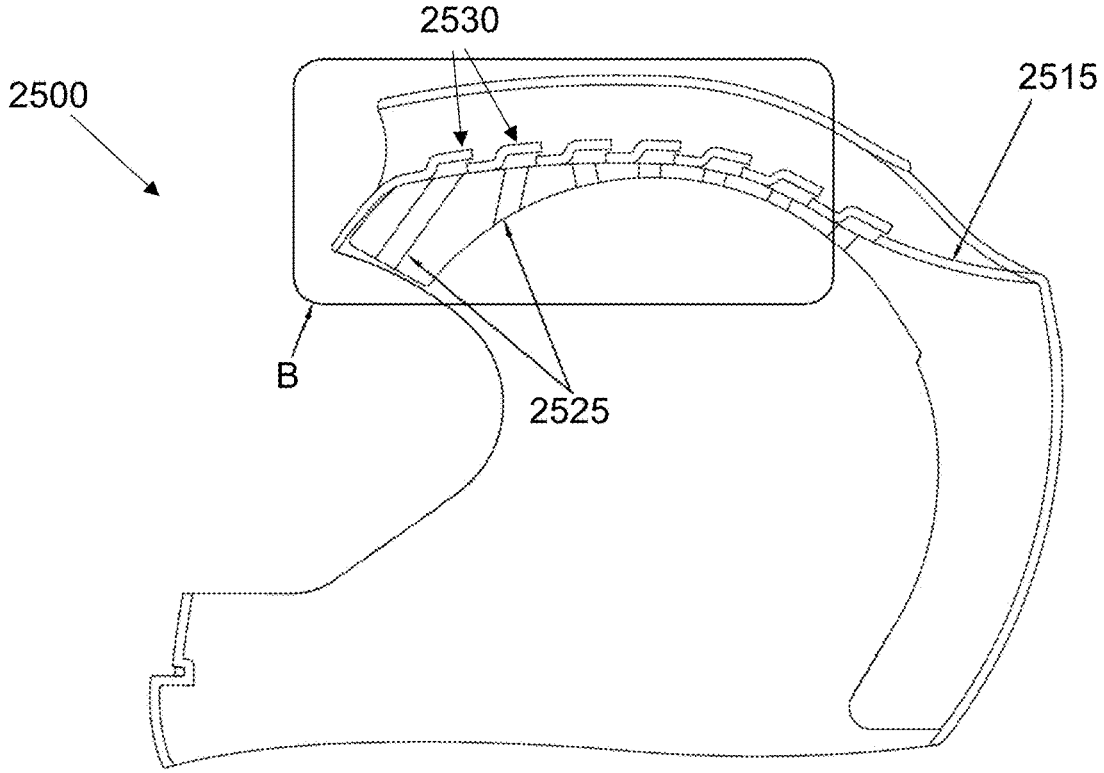
FIG. 29 illustrates a side cross-sectional view of the helmet through A-A of FIG. 28.

FIG. 28 illustrates a top view of the helmet 2500, and FIG. 29 illustrates a side cross-sectional view of the helmet through A-A of FIG. 28. As best illustrated in FIGS. 28 and 29, air flow pathways 2525 are provided between an inside of the helmet 2500 to the channel 2505. As the exit 2515 is larger than the central portion of the channel 2505, a venturi effect is provided in the channel 2505, which thereby causes low pressure in the channel at the air flow pathways 2525. This low pressure causes air to flow through the air flow pathways 2525 thereby ventilating the helmet.

As illustrated in FIG. 29, raised covers 2530 are provided above each air flow pathway 2525, in a reverse cowl like arrangement, to stop water leaking in helmet when raining. In particular, as air flows through the channel 2505, any water with the air will also flow through the channel 2505. Each air flow pathway 2525 is protected by the covers 2530 which overhang the openings of the air flow pathways 2525, and any water in the channel will travel along the tops of each cover 2530, out of the channel 2505.

The covers 2530 are arranged in rows, corresponding to tow of the air flow pathway 2525. Groove-like valleys 2535 are defined between adjacent rows, which are also useful for transporting any water that makes its way into the channel 2505 out of the channel 2505 again.

Figure 30:
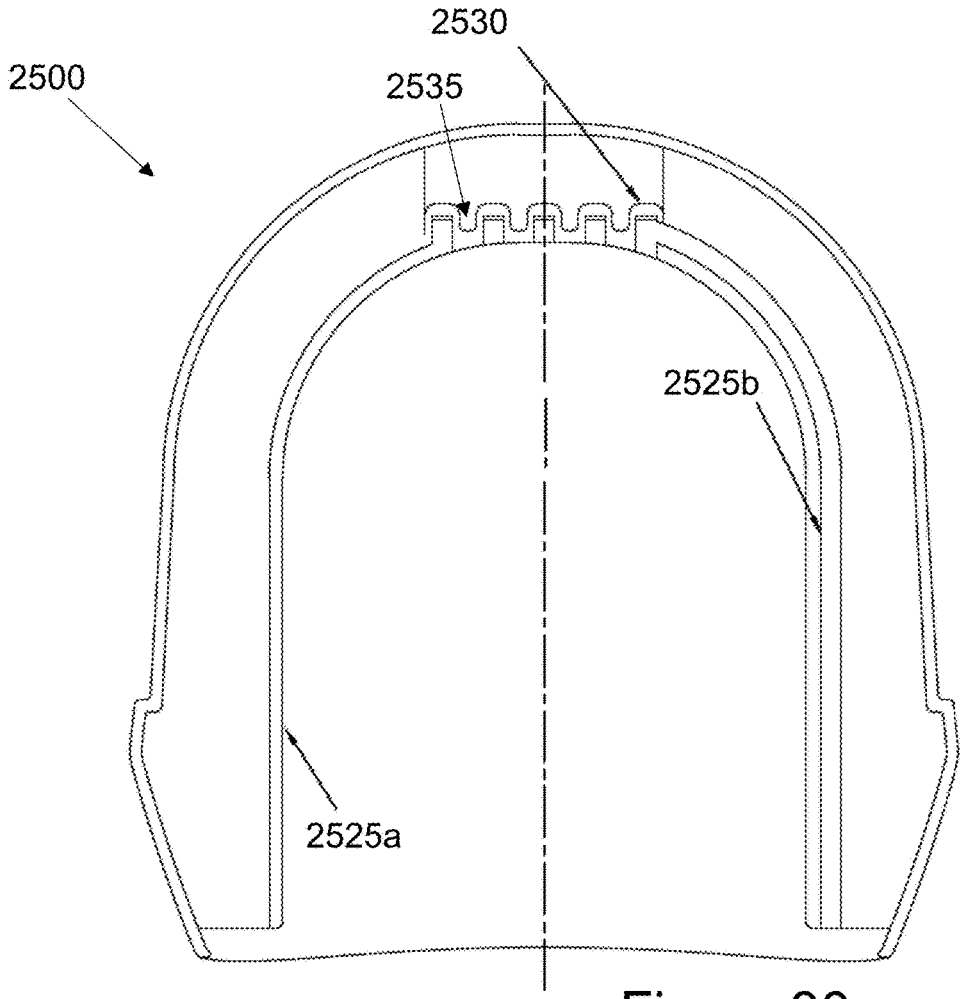
FIG. 30 illustrates a front cross-sectional view of the helmet of FIG. 25, illustrating two different types of air flow pathways through the helmet.

FIG. 30 illustrates a front cross-sectional view of the helmet 2500, illustrating two different types of air flow pathways 2525 through the helmet 2500.

The air flow pathways 2525 include air grooves 2525*a*, defined in an inner surface (foam) of the helmet 2500. The grooves 2525*a* extend vertically along a height of the helmet 2500, and thus allows air to flow from an inside of the helmet 2500 from any point. The grooves allow air that enters at the bottom of the helmet 2500 to flow along an entire inside of the helmet 2500, adjacent to the rider's head, to thereby cool the helmet 2500 and thus the rider's head.

The air flow pathways 2525 also include hose-like channels 2525*b*, defined in the inner surface of the helmet 2500. The channels 2525*b* extend from an opening at the lower end of the helmet 2500, to an exit in the channel 2505. The channels 2525*b* would generally extend from different parts of the helmet 2500 to the channel 2505, to thereby ventilate the helmet 2500. The air flow pathways 2525 may include dimples therein to improve airflow through the pathways 2525.

While grooves 2525*a* and channels 2525*b* are illustrated on respective sides of the helmet, in a typical scenario only grooves 2525*a* or channels 2525*b* would be used on sides of the helmets, and the presence of both in the single helmet is simply to illustrate different options in a simple manner.

Figure 31:
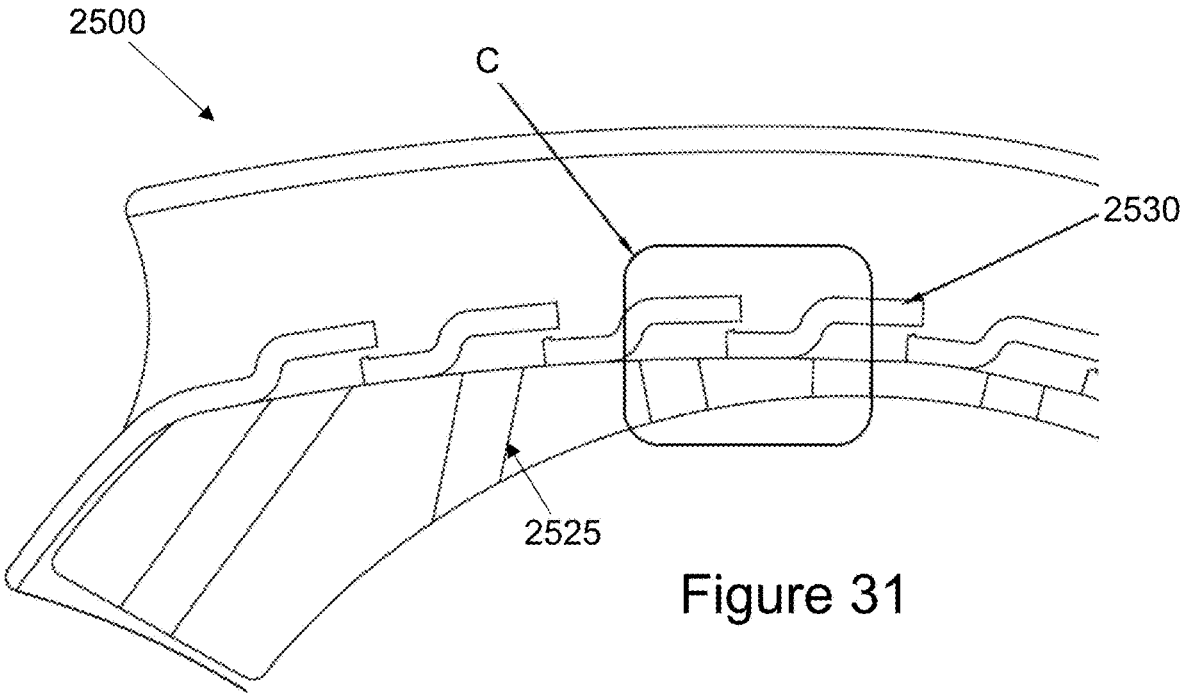
FIG. 31 illustrates a side cross-sectional view of the helmet of FIG. 25, illustrating area B of FIG. 29.
Figure 32:
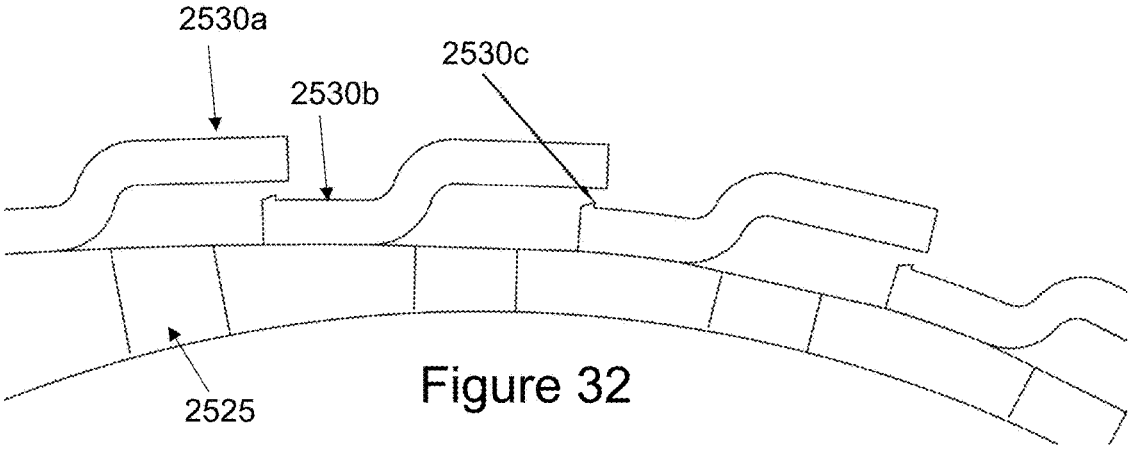
FIG. 32 illustrates a side cross-sectional view of the helmet of FIG. 25, illustrating area C of FIG. 31.

FIG. 31 illustrates a side cross-sectional view of the helmet 2500, illustrating area B of FIG. 29. FIG. 32 illustrates a side cross-sectional view of the helmet 2500, illustrating area C of FIG. 31.

The covers 2530 comprise a base 2530*b*, attached to a lower edge of the channel 2505, and an upper cover portion 2530*a*, positioned directly above, and overhanging the air flow pathways 2525. The covers 2530 are arranged end-to-end in their respective rows such that the upper cover portion 2530 of one cover 2530 overlaps/overhangs the base 2530*b* of an adjacent cover 2530.

An edge of the base 2530*a* includes a lip 2530*c*, which prevents any water which drips over from one cover from entering the air flow pathways 2525. The lip 2530 may also increase strength, and provide a crush zone, in the helmet.

As outlined above, dimples 2520 are provided at the outer surface of the opening 2510, and through the channel 2505. In particular, dimples are provided on cover 2530, to increase airflow through the channel 2505.

Figure 33:
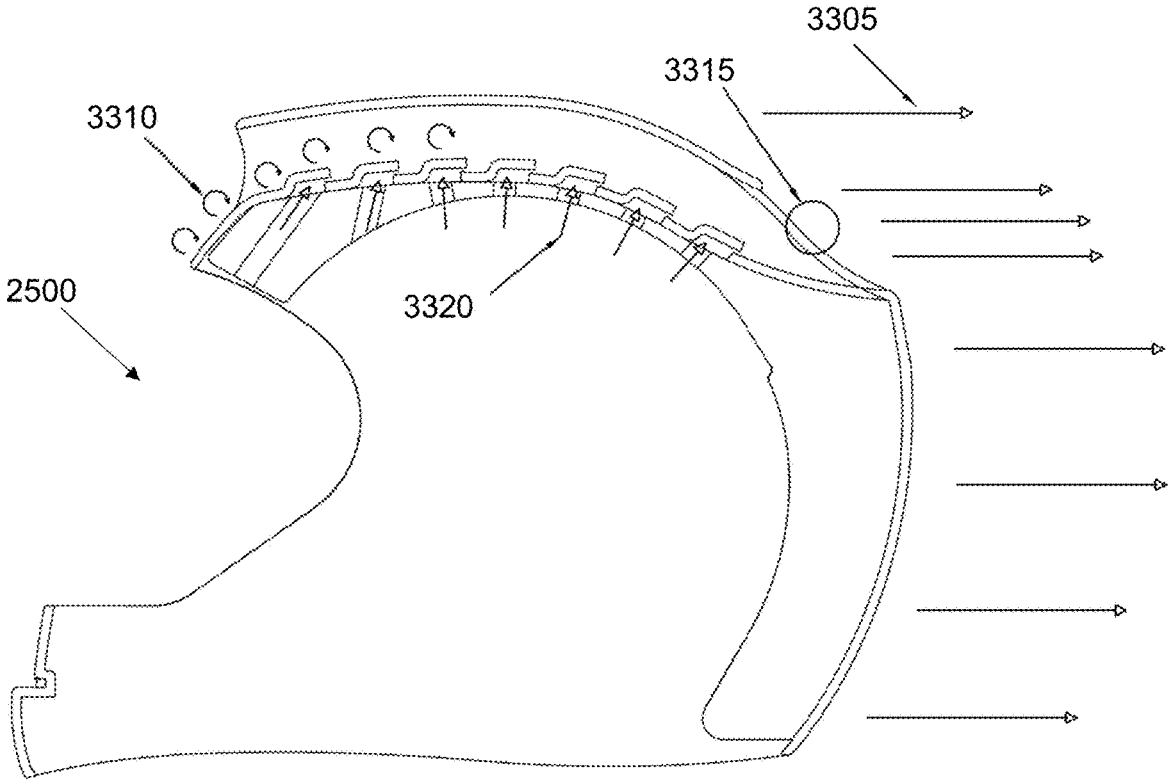
FIG. 33 illustrates a side cross-sectional view of the helmet of FIG. 25, illustrating the use, according to an embodiment of the present invention.

FIG. 33 illustrates a side cross-sectional view of the helmet 2500, illustrating the use, according to an embodiment of the present invention.

When air travels over the smooth surface of the helmet sides and top air becomes detached from the surface creating a lower air pressure behind the helmet as shown by arrows 3305.

The vent at the front of the channel 2505 coupled with the dimples 2520 creates turbulence as shown by arrows 3310, thereby reducing resistance to air flowing inside the helmet.

The channel 2505 tapers to a greater size opening at the rear of the helmet creating a venturi effect and low pressure at the circle 3315.

The venturi effect draws air from inside the helmet, through the air flow pathways 2525 (which function as ducts) and into the channel 2505 and then out through the rear of the helmet, as illustrated by arrows 3320.

While not illustrated, the helmet 2500 will generally include a visor, and the air flow pathways 2525 at the front of the helmet are configured to ventilate the visor and thereby avoid fogging of the visor.

While the above description illustrates several independent air flow pathways 2525, the skilled addressee will readily appreciate that multiple air flow pathways may be joined. For example, air flow pathways may be joined in a branched manner, and/or forming a network of air flow pathways. As an illustrative example, a single (or small number of) openings may be coupled to air flow pathways that branch into multiple parts of the helmet.

In some embodiments, the channel 2505 may include a shutter, to enable the wearer to adjust a level of flow though the channel 2505, and thus a level of ventilation in the helmet 2500.

Figure 34:
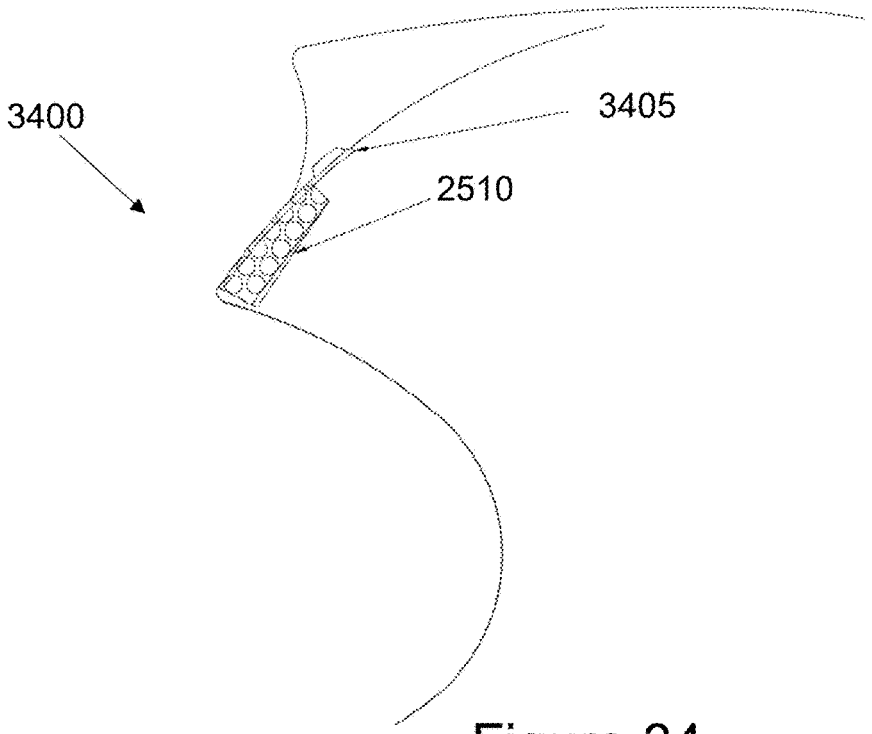
FIG. 34 illustrates a side view of a helmet, with a shutter in a closed position, according to an embodiment of the present invention.
Figure 35:
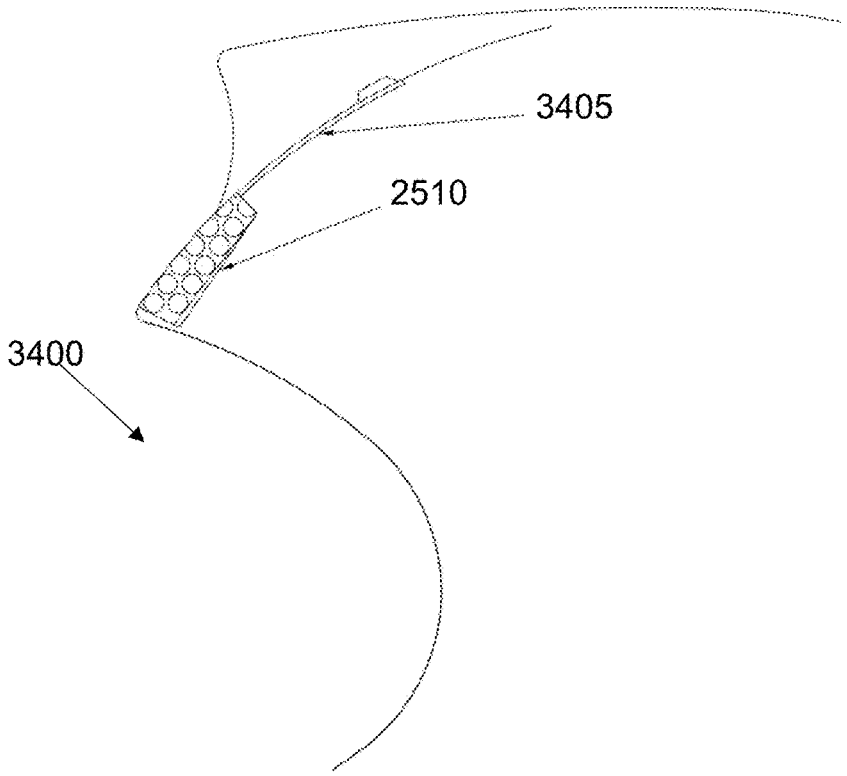
FIG. 35 illustrates a side view of the helmet, with the shutter in an open position.

FIG. 34 illustrates a side view of a helmet 3400, with a shutter 3405 in a closed position, according to an embodiment of the present invention. FIG. 35 illustrates a side view of the helmet 3400, with the shutter 3405 in an open position.

The shutter 3405 slides up and down, opening and closing the opening 2510 and thereby the channel. This enables the wearer of the helmet to adjust a level of air flow through the channel 2505 and thereby the level of ventilation in the helmet.

While not illustrated, the helmets 2500, 3400 may include dimples on an outer surface thereof. In such case, the dimples may be arranged in rows from a front to a rear of the helmet, to thereby direct airflow from a front to a rear of the helmet.

The helmets 2500, 3400 may further include moulded channels, which channel airflow across the helmet. The moulded channels may taper towards a rear of the helmet and a plurality of dimples may extend along a length of the channels. The inventor believes that the use of dimples in channels improves aerodynamics over one of channels or dimples alone.

As outlined above, the helmets 2500, 3400 may include a visor. Dimples may be provided on a surface of the visor to optimise airflow without impeding vision. The visor may be partly or fully dimpled. In a partly dimpled configuration, the dimples may leave a clear visual strip (i.e. clear from dimples). In a fully dimpled configuration, the dimples may be sized so that they do not significantly impact vision through the visor.

The dimples may be uniform in shape and/or size, or include multiple shapes and/or sizes. Any suitable shape or combination of shapes that is within regulations for that helmet.

While the above embodiment illustrates a motorcycle helmet, the skilled addressee will readily appreciate that the present invention may be used on any type of helmet including sporting helmets (e.g. bicycle helmets), and for helmets designed to be used on land and sea.

Advantageously, the helmets may reduce drag, which in turn may increase performance, and/or decrease stress on the user's head.

As outlined above, other types of sporting articles may incorporate the above teachings.

Figure 36:
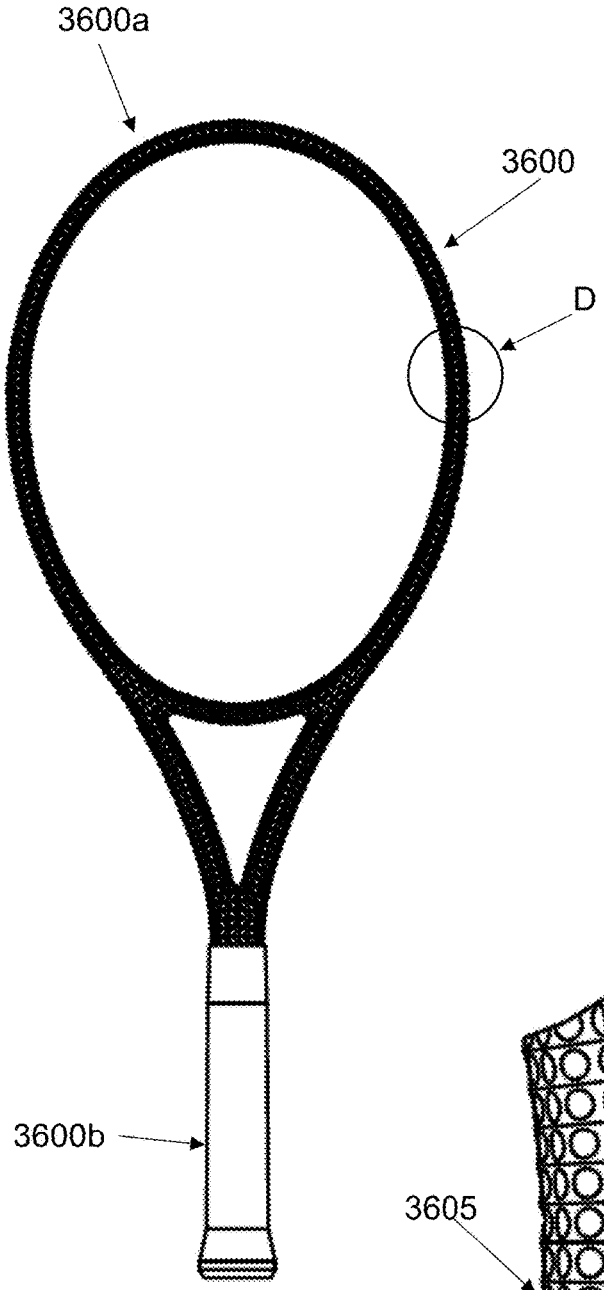
FIG. 36 illustrates a tennis racket, according to an embodiment of the present invention.
Figure 37:
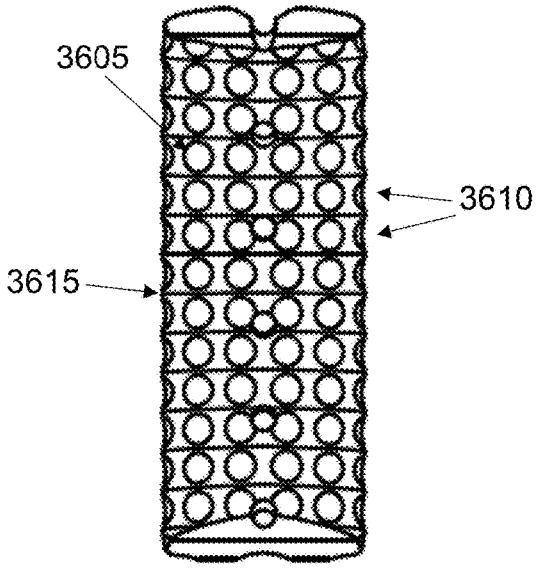
FIG. 37 illustrates an inside view of area D of the tennis racket of FIG. 36.
Figure 38:
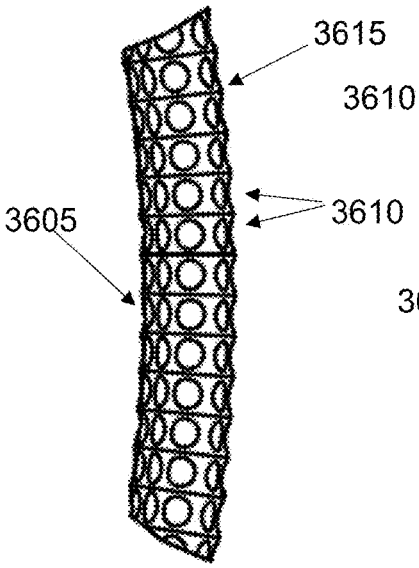
FIG. 38 illustrates a front view of area D of the tennis racket of FIG. 36.
Figure 39:
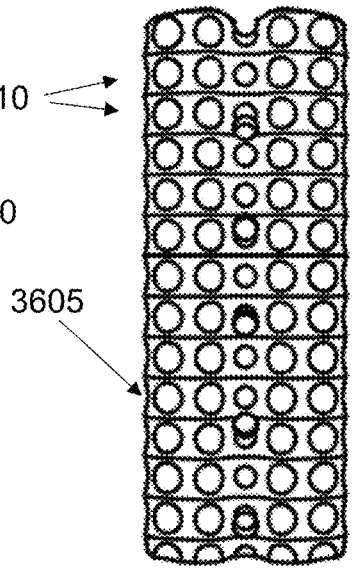
FIG. 39 illustrates an outside view of area D of the tennis racket of FIG. 36.

FIG. 36 illustrates a tennis racket 3600, according to an embodiment of the present invention. FIG. 37 illustrates an inside view of area D of FIG. 36, FIG. 38 illustrates a front view of area D, and FIG. 39 illustrates an outside view of area D.

The tennis racket 3600 includes a body in the form of a frame 3600*a*, a handle 3600*b*, and a plurality of strings (not illustrated for the sake of clarity) provided in an opening defined by the frame 3600*a*.

The frame 3600*a* includes a plurality of dimples 3605 arranged in channels 3610, to decrease drag of the frame 3600*a* (and thus racket 3600) when swung by the user by generating a boundary layer of air immediately adjacent to the frame 3600*a*. In particular, the frame includes a plurality of ridges 3615, defined on a surface of the frame 3600*a*, the ridges defining the channels 3610 therebetween.

The ridges 3615, and thus the channels 3610 are aligned with a direction of flow of air across the racket 3600 when swung (i.e. from a front to rear of the racket). The ridges 3615 function to guide the air, and work together with the dimples 3605 to increase aerodynamic performance while providing additional stability to the racket 3600 as it moves through the air.

In particular, the ridges 3615 focus the movement of air through the channels 3610, and the channels focus movement of air over the dimples 3605 and in alignment with the rows of dimples 3605. This combination of dimples 3605, ridges 3615 and channels 3610 creates a smoother flow of air over and through each channel 3610 and across the dimples in each channel 3610.

The dimples 3605 may be similar or identical to the dimples described above in the context of golf clubs and helmets.

The dimples 3605 extend around the frame 3600*a* in the channels 3610, and are thus located on both an inside, side, and outside of the racket 3600. This maintains symmetry, enabling the racket 3600 to function in both directions.

Much like the golf clubs described above, the racket 3600 has reduced wind resistance, which may decrease the risk of injury, or increase swing speeds.

In alternative embodiments, the racket may include weights, similar to the weights described above, to adjust a balance of the tennis racket.

Figure 40:
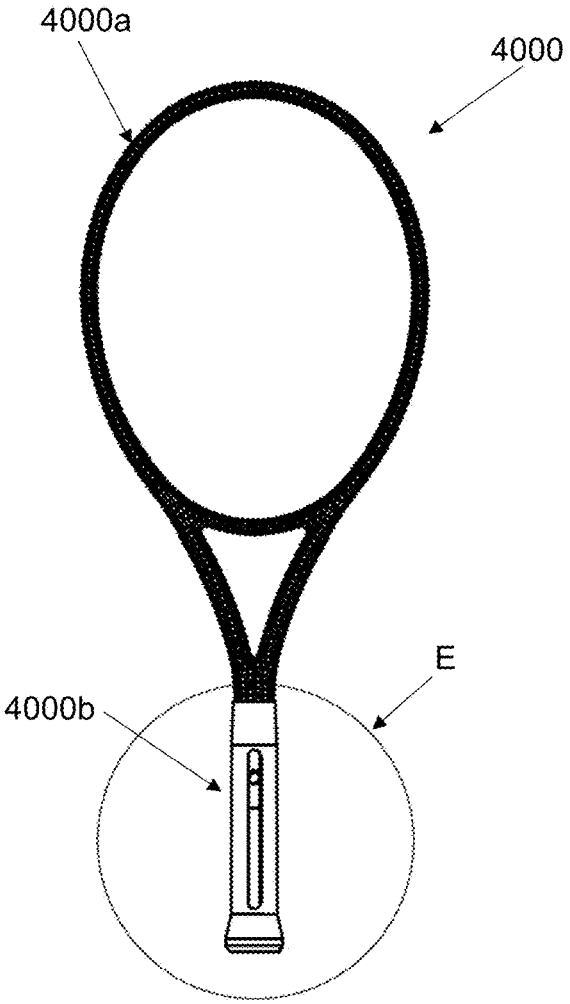
FIG. 40 illustrates a front view of a tennis racket, according to an embodiment of the present invention.
Figure 41:
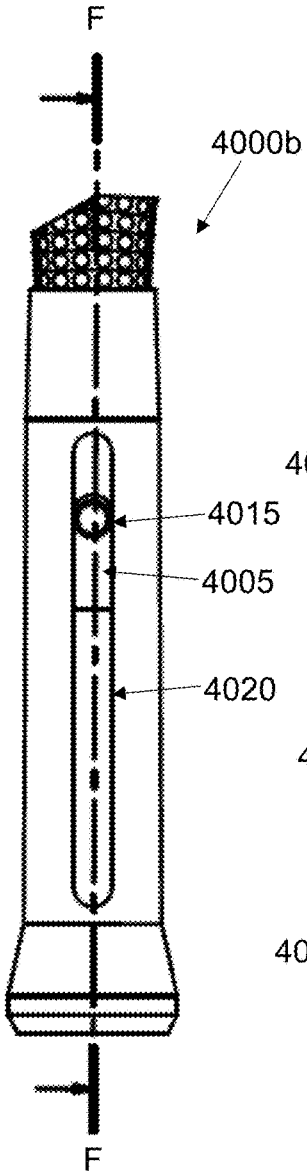
FIG. 41 illustrates area E of the tennis racket of FIG. 40.
Figure 43:
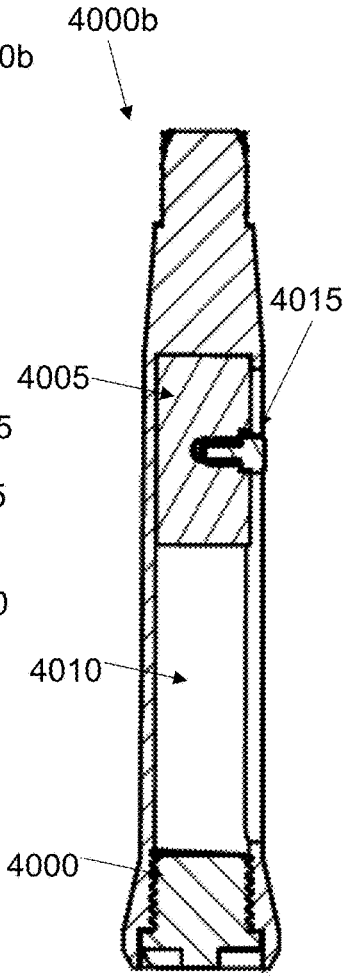
FIG. 43 illustrates a cross sectional view of the handle of the racket of FIG. 40 through F-F of FIG. 41.
Figure 42:
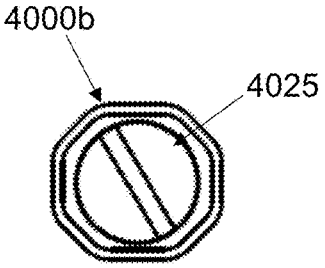
FIG. 42 illustrates an end view of a handle of the racket of FIG. 40.

FIG. 40 illustrates a front view of a tennis racket 4000, according to an embodiment of the present invention. FIG. 41 illustrates area E of FIG. 40, FIG. 42 illustrates an end view of a handle 4000*b* of the racket 4000, and FIG. 43 illustrates a cross sectional view of the handle 4000*b* through F-F of FIG. 41.

The tennis racket 3600 includes a body in the form of a frame 4000*a*, which is similar to the body 3600*a*, and includes dimples. Strings (not illustrated for the sake of clarity) are provided in an opening defined by the frame 4000*a*.

The frame 4000*a* includes a plurality of dimples arranged in channels, to decrease drag of the frame 4000*a* (and thus racket 4000) when swung by the user by generating a boundary layer of air immediately adjacent to the frame 4000*a*, as outlined above in relation to the racket 3600.

The handle 4000*b* includes a weight 4005 movable along a length of the handle 4000*b* to change a balance of the handle and racket 4000. In particular, the handle includes a cylindrical chamber 4010 along which the weight 4005 may be moved. The weight 4005 fits snugly in the chamber 4010, and therefor does not move or rattle in use.

A knob 4015 is provided in the weight 4005, which enables the position of the weight 4005 to be adjusted within the chamber 4010. The knob 4015 extends through an elongate channel 4020, which enables access to the knob 4015 from an outside of the handle 4000*b*, while also providing a visual indicator of a location of the weight 4005 with reference to the handle 4000*b*.

By moving the weight 4005 up towards the strings, a more powerful serve may be achieved. By moving the weight 4005 towards a lower portion of the handle, a more balance racket 4000 may be provided.

The handle 4000*b* further includes a removable end cap 4025, which enables access to the chamber 4010 to be provided. This enables the weight 4005 to be replaced or removed, for example.

The weights may vary from between about 25 g to about 120 g depending on preference. In some embodiments, the weights may be removable to enable the user to choose a weight having a size of his or her choosing.

Smaller and/or weaker players may desire lighter weights, while stronger players may desire heavier weights, especially if they play at the net a lot (e.g. when playing doubles).

As such, not only can the position of the weight be chosen by the player, but also the size of the weight, depending on what their strengths or weaknesses are, and/or what kind of game they are playing. For example, players at the net may choose weights to be positioned further up the handle, for stronger and more powerful slams. In contrast, a player playing further back may choose to prioritise a balanced tennis racket, with a weight closer to the bottom of the handle.

While the chamber is illustrated as being cylindrical, the skilled addressee will readily appreciate that it may take any suitable shape, but is preferably uniform in cross section along its length.

The handle may be formed of two parts, and the cylindrical chamber may be defined in one part. This is particularly useful in case a frame is defined continuously from one side of the handle, around the opening, and back to the other side of the handle, such as the case for a bent tube tennis racket.

In alternative embodiments, a lower end of the handle may rotate, thereby moving a weight up and down in the handle, e.g. using a threaded shaft and cylindrical chamber, much like in the golf club, but sized and shaped for the handle.

The handle may be extended in length, compared to a typical handle, thereby enabling the weight to move a greater distance with reference to the user's hand. This in turn enables the weight to be positioned higher, and therefore a greater force be applied to the tennis ball.

Figure 44:
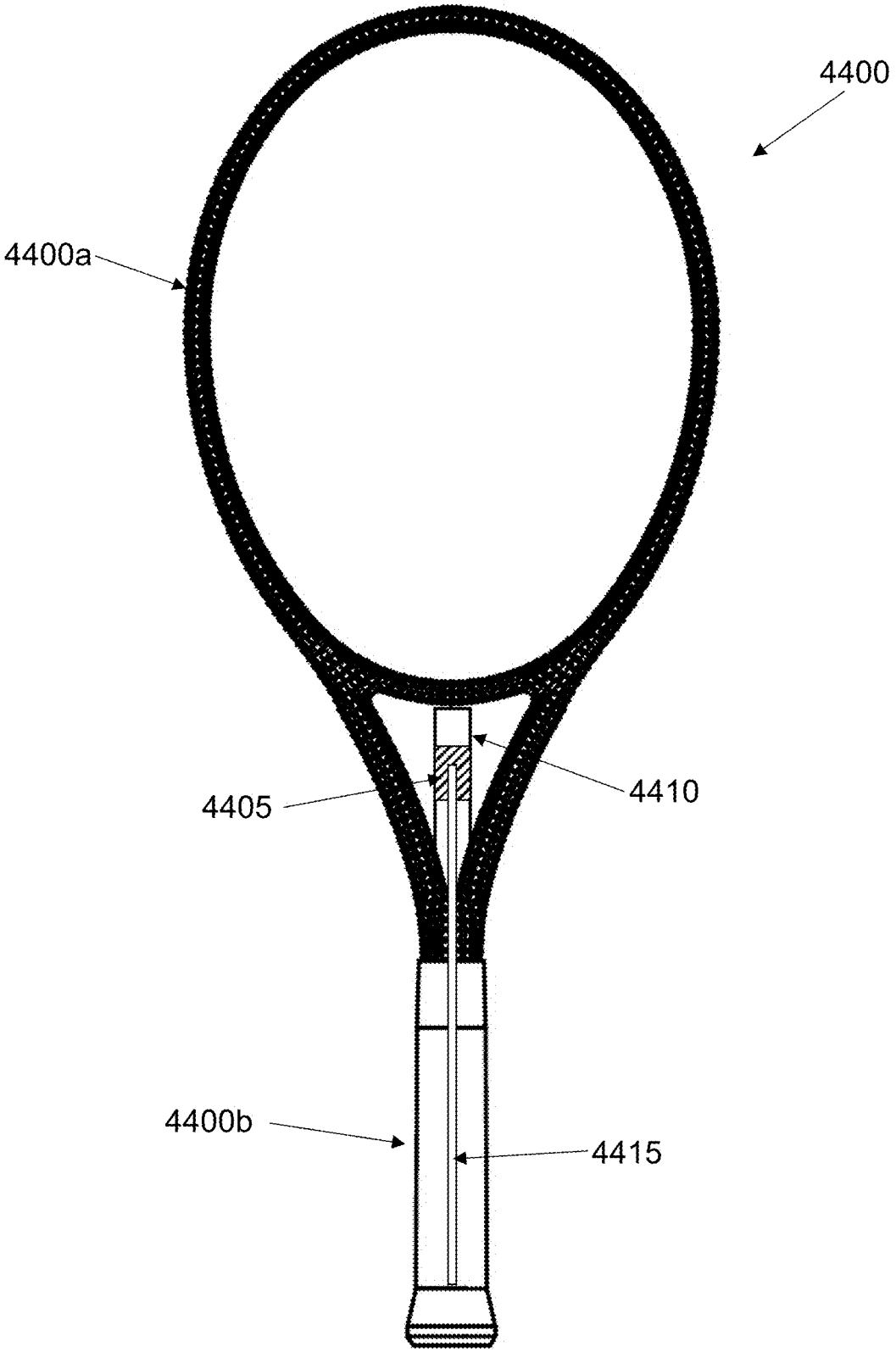
FIG. 44 illustrates a front view of a tennis racket, with a weight assembly, according to an embodiment of the present invention.

FIG. 44 illustrates a front view of a tennis racket 4400, with a weight assembly, according to an embodiment of the present invention. Certain parts of the weight assembly are illustrated, despite generally being hidden by the handle, to clearly illustrate the weight assembly.

The tennis racket 4400 is similar to the racket 4000 and includes a frame 4400*a*, which includes dimples, and strings (not illustrated for the sake of clarity) are provided in an opening defined by the frame 4400*a*.

The racket 4400 includes a handle 4400*b*, and a weight 4405 movable along a length of the racket 4400 along an axis of the handle 4400*b* to change a balance of the handle and racket 4400. In particular, a cylindrical chamber 4410 extends outwardly from an end of the handle 4400*b*, towards the opening, and along which the weight 4405 may be moved. The weight 4405 fits snugly in the chamber 4410, and therefor does not move or rattle in use.

A shaft 4415 extends along a length of the handle 4400*b* and engages with the weight to enable a position of the weight 4405 to be adjusted within the chamber 4410. The shaft may be threaded, or at least partly threaded, whereby adjustment of the weight 4405 is performed by rotation of the shaft (similar to adjustment of the weight in the golf club head, as described above). Alternatively, the shaft 4415 may move lengthwise in the handle, thereby causing the weight 4405 to move lengthwise in the chamber 4410.

By moving the weight 4405 up towards the strings, a more powerful serve may be achieved. By moving the weight 4405 towards a lower portion of the handle, a more balance racket 4400 may be provided.

Figure 47:
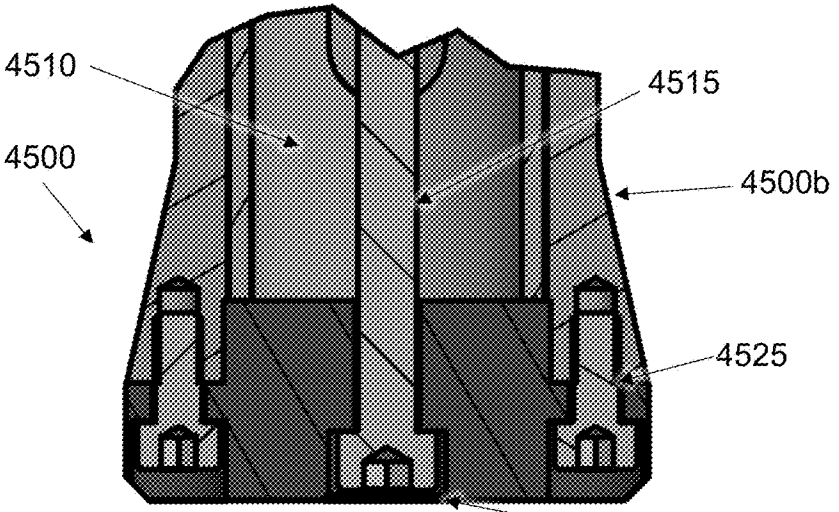
FIG. 47 illustrates an enlarged cross-sectional view of a lower portion (corresponding to Area F of FIG. 46) of the handle of the tennis racket of FIG. 45.
Figure 45:
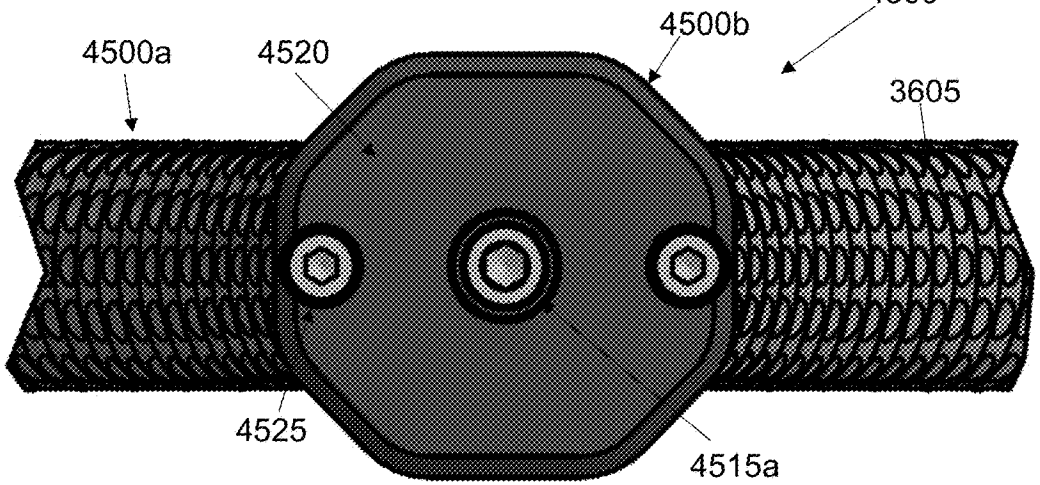
FIG. 45 illustrates a bottom view of a tennis racket, with a weight assembly and dimples, according to an embodiment of the present invention.
Figure 46:
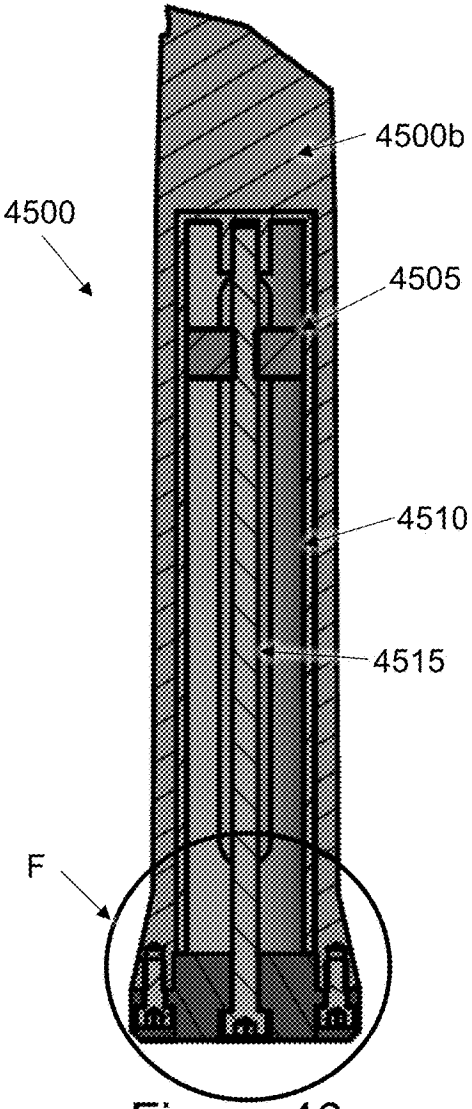
FIG. 46 illustrates a cross sectional view of a handle of the tennis racket of FIG. 45.

FIG. 45 illustrates a bottom view of a tennis racket 4500, with a weight assembly and dimples 3605, according to an embodiment of the present invention. FIG. 46 illustrates a cross sectional view of a handle 4500*b* of the tennis racket 4500, and FIG. 47 illustrates an enlarged cross sectional view of a lower portion (corresponding to Area F of FIG. 46) of the handle 4500*b* of the tennis racket 4500.

Much like the tennis rackets described above, the racket 4500 includes a frame 4500*a* the extends upwardly from the handle 4500*b* to define an opening, across which strings (not shown) extend.

The frame 4500*a* is substantially entirely covered in dimples 3605, arranged in channels separated by ridges. Such configuration is particularly aerodynamic, similar to the racket 3600.

The handle 4500*b* includes the weight assembly, which comprises a weight 4505 movable along a length of the racket 4500 along an axis of the handle 4500*b* to change a balance of the handle and racket 4400. In particular, a cylindrical (or any other suitably shaped) chamber 4510 extends outwardly from an end of the handle 4500*b*, and along which the weight 4505 may be moved. The weight 4505 fits snugly in the chamber 4510, and therefore does not move or rattle in use.

A shaft 4515 extends along a length of the handle 4500*b* and engages with the weight to enable a position of the weight 4505 to be adjusted within the chamber 4510. The shaft 4515 may be threaded, or at least partly threaded, whereby adjustment of the weight 4505 is performed by rotation of the shaft 4505 using a head 4515*a* thereof, which is accessible from an outside of the racket 4500.

The racket 4500 includes a removable end cap 4520, which is retained to the handle 4500*b* by first and second screws 4525. The head 4515*a* of the shaft 4505 extends through the end cap 4520, enabling access to the head 4515*a* from the outside of the handle 4500*b*. As such, the position of the weight may be simply adjusted through rotation of the head 4515*a*.

The end cap 4520 may be removed by unscrewing the screws 4525, enabling the end cap 4520 to be removed in its entirety from the handle 4500*b*. This provides access to the internal weight mechanism, enabling the internal weight mechanism (or part thereof) to be removed and replaced. This enables the internal weight mechanism to be replaced with larger or smaller weights, for example, based upon need.

Figure 48:
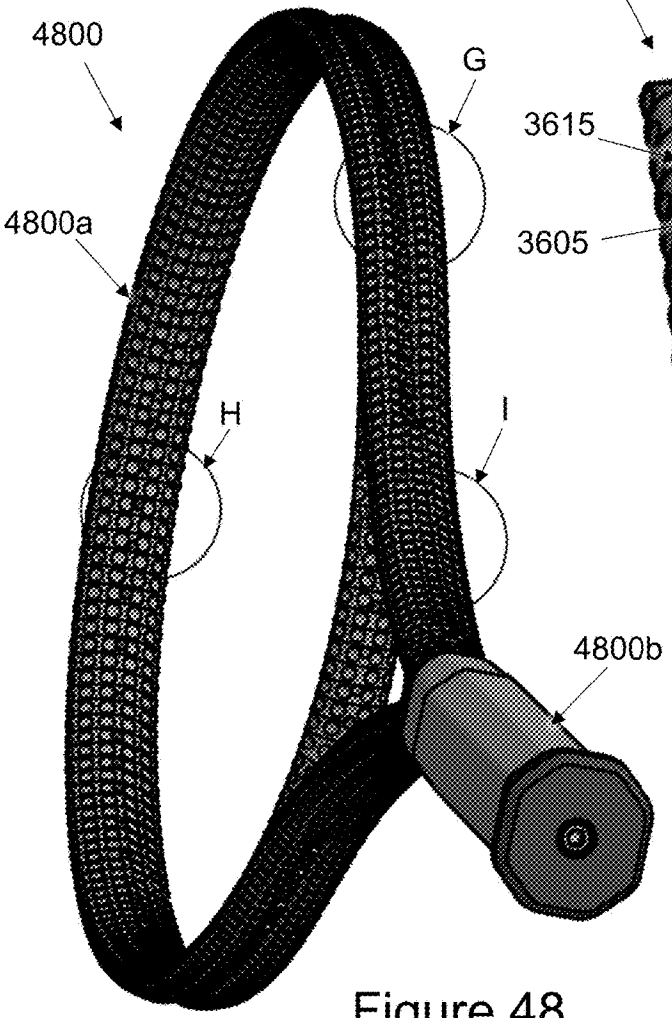
FIG. 48 illustrates a bottom view of a tennis racket, with a weight assembly and dimples, according to an embodiment of the present invention.

FIG. 48 illustrates a bottom view of a tennis racket 4800, with a weight assembly and dimples 3605, according to an embodiment of the present invention.

The racket 4800 is similar to the racket 4500 and includes a frame 4800*a* the extends upwardly from the handle 4800*b* to define an opening, across which strings (not shown) extend. The frame 4800*a* may be similar or identical to the frame 4500*a*, and include dimples 3605.

Figure 50:
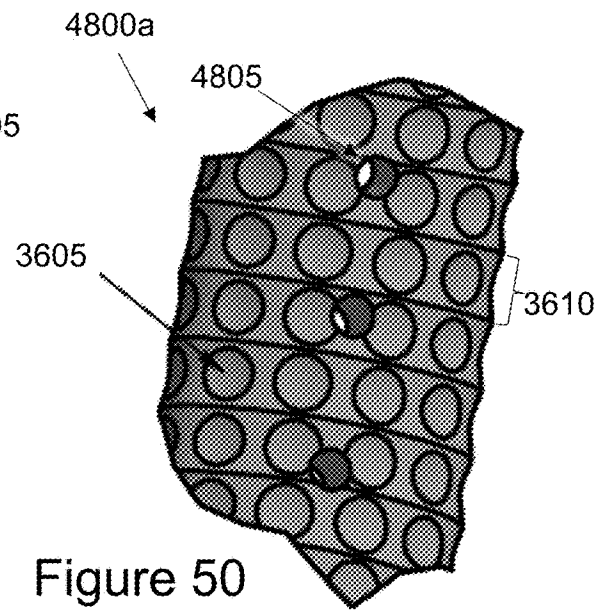
FIG. 50 illustrates an enlarged view of Area H of the tennis racket of FIG. 48.
Figure 49:
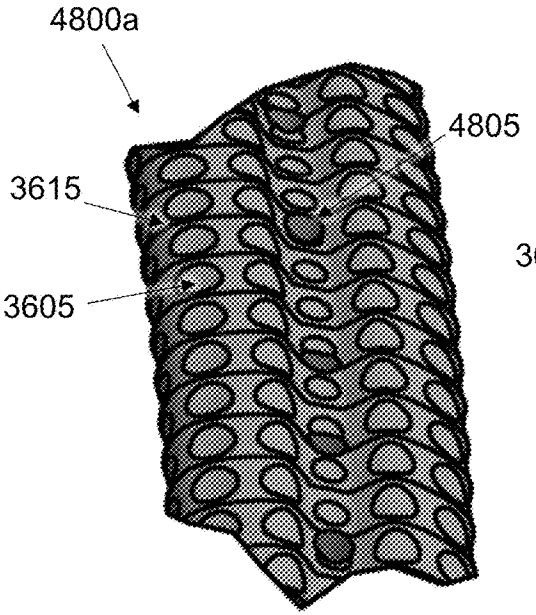
FIG. 49 illustrates an enlarged view of Area G of the tennis racket of FIG. 48.
Figure 51:
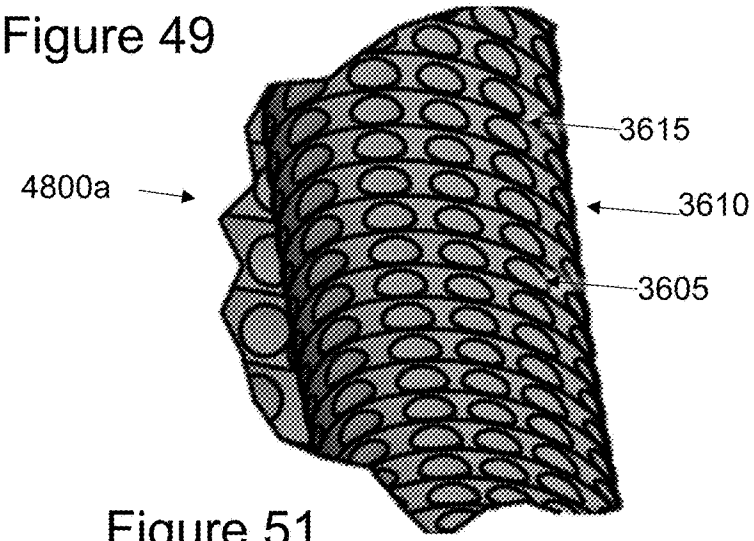
FIG. 51 illustrates an enlarged view of Area I of FIG. 48.

FIG. 49 illustrates an enlarged view of Area G of FIG. 48, FIG. 50 illustrates an enlarged view of Area H of FIG. 48 and FIG. 51 illustrates an enlarged view of Area I of FIG. 48.

The dimples 3605 cover substantially the entire frame 4800, and are arranged in rows. A plurality of ridges 3615 are defined on a surface of the frame 4800*a* racket 4800, defining channels 3610 in which the dimples 3605 are located.

The channels 3610, ridges 3615 and thus rows of dimples 3605 are aligned with a direction of flow of air across the racket 4800 when swing, i.e. from a front to rear of the racket. Such configuration provides a improved aerodynamics over dimples alone, as outlined above.

The dimples 3605 are arranged in a single row in each channel 3610, but in alternative embodiments are arranged in one or more rows in the channels.

As best illustrated in FIGS. 49 and 50, the frame 4800*a* includes string apertures 4805, which extend through the frame, for receiving strings (not shown).

Figure 53:
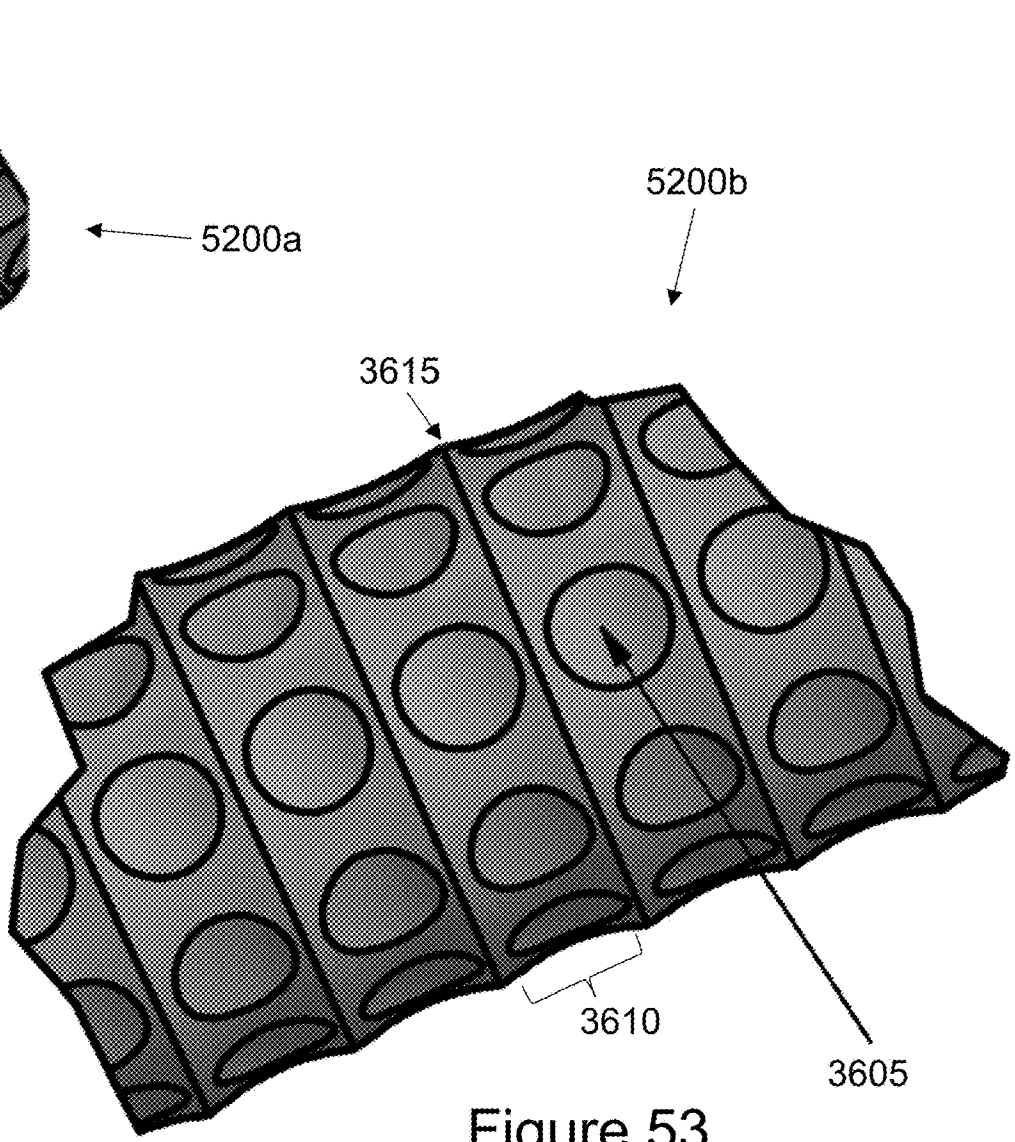
FIG. 53 illustrates another enlarged portion of a racket, such as the racket of FIG. 48, illustrating the dimples, ridges and channels in greater detail.
Figure 52:
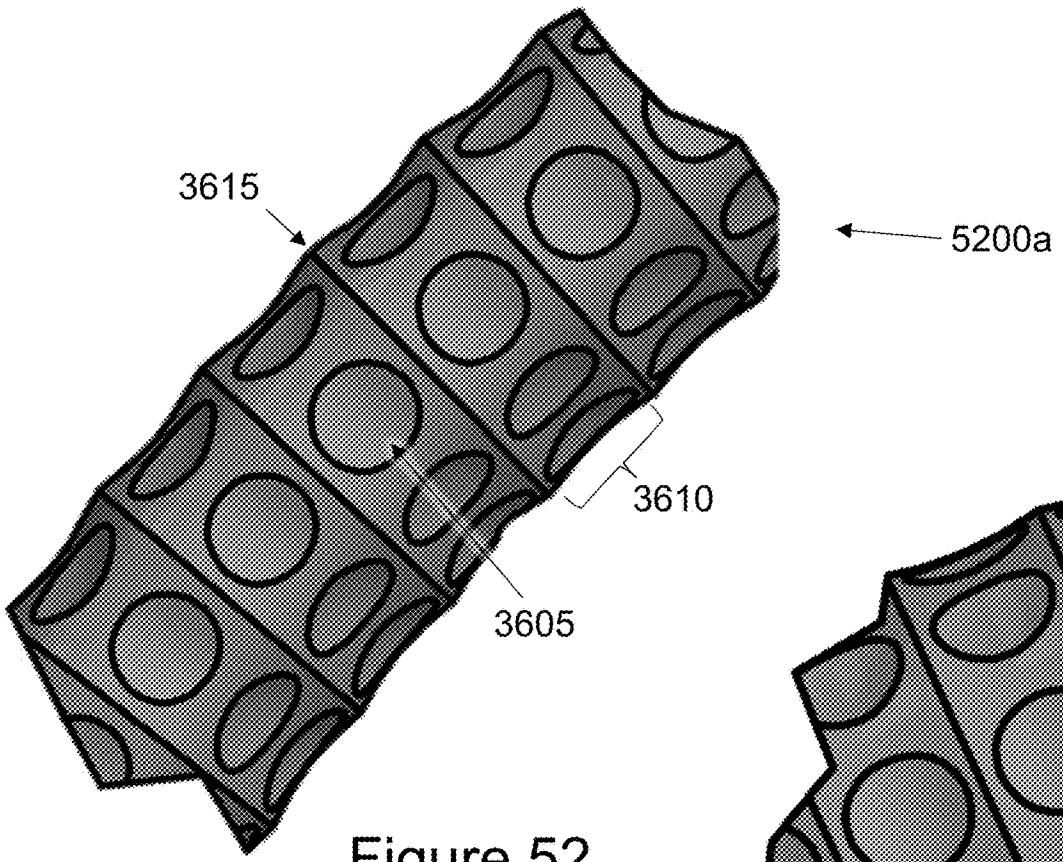
FIG. 52 illustrates an enlarged portion of a racket, such as the racket of FIG. 48, illustrating the dimples, ridges and channels in greater detail.

FIGS. 52 and 53 illustrate enlarged portions 5200*a*, 5200*b* of a racket, such as the racket 4800, illustrating the dimples, ridges and channels in greater detail.

The ridges 3615 define channels 3610, in which a single row of dimples 3605 is provided.

The dimples 3605 have a diameter of 4.0 mm, and a depth of 0.6 mm. The channels have a width of 5.0 mm, and as such, the peaks of the ridges 3615 have a spacing of 5.0 mm. The peaks of the ridges 3615 are 0.3 mm high.

Such configuration has been shown to significantly improve aerodynamics of the tennis rackets, as outlined in further detail below.

EXPERIMENTAL RESULTS

The force applied to a racket in motion corresponds to the force applied to a stationary racket in a moving air stream, as the only difference is the frame of reference. As such, a series of wind tunnel experiments were carried out to determine the forces applied to a tennis racket corresponding to that of the racket 4800 with the dimensions outlined above, and that of an equivalent racket without channels and ridges, and with non-aligned dimples (i.e. similar to that found on a Golf Ball). The rackets were identical in geometric dimension, only varying in their surface texturing.

The tests were performed with the racket face oriented normal to the direction of wind, i.e. $\theta=0°$, and when they were rotated clockwise to an angle of $\theta=7.5°$.

Reductions in total and drag force coefficients of approximately 7% and 14% were noted for these two orientations when comparing the racket with dimples, channels and ridges with that of the racket without channels and ridges, and non-aligned dimples.

While the above dimensions and arrangement have been shown to particularly good at improving aerodynamics, however the skilled addressee will readily appreciate that these dimensions may be modified, without deviating from the present invention.

While the above embodiments describe tennis rackets with dimples defined on a surface of the frame, in other embodiments, bumpers for installation on tennis rackets are provided, the bumpers including dimples, to improve aerodynamics of the tennis racket. This enables existing tennis rackets to be adapted in a simple and cost effective manner.

Figure 55:
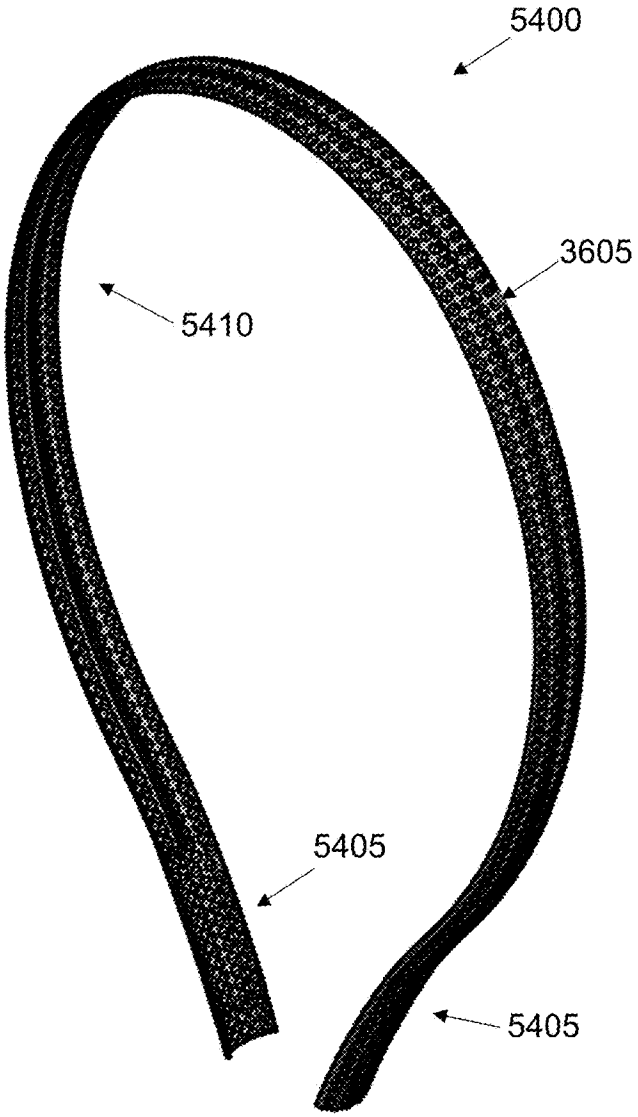
FIG. 55 illustrates a lower perspective view of the bumper of FIG. 54.
Figure 54:
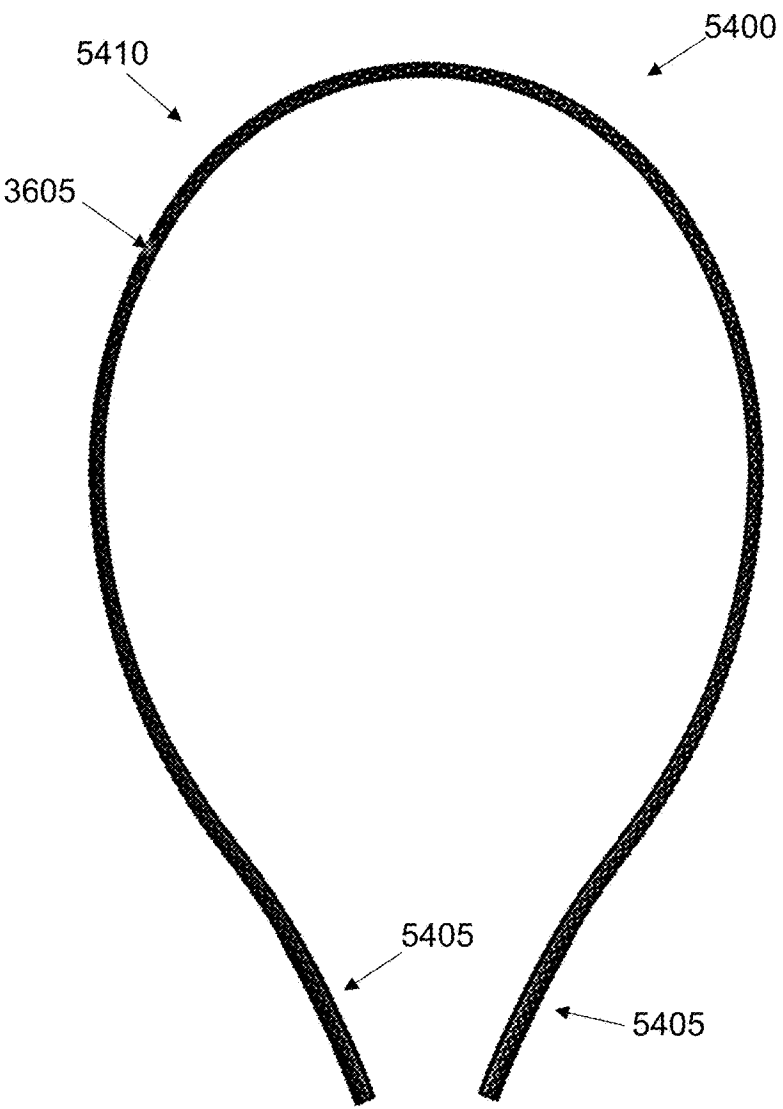
FIG. 54 illustrates a front view of a bumper, for installation onto a tennis racket, according to an embodiment of the present invention.
Figure 56:
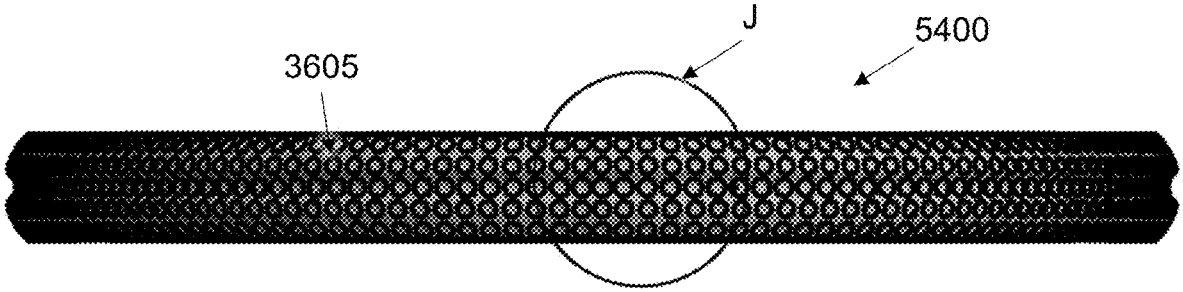
FIG. 56 illustrates a top view of the bumper of FIG. 54.
Figure 57:
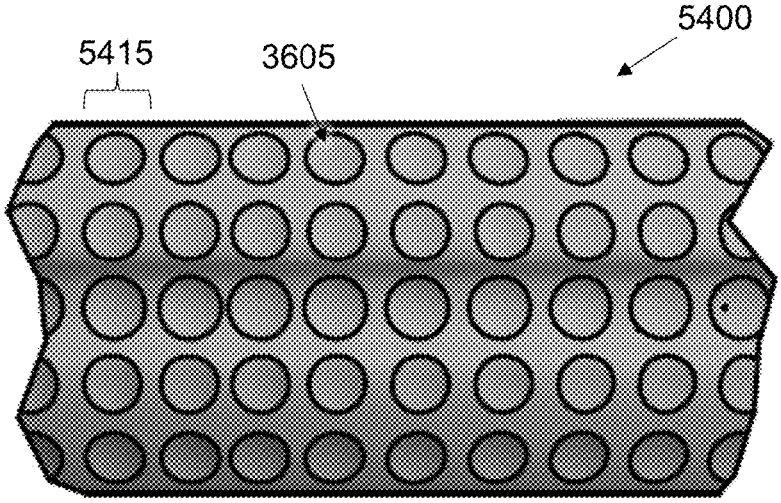
FIG. 57 illustrates an enlarge portion of the bumper of FIG. 54, corresponding to Area J of FIG. 56.

FIG. 54 illustrates a front view of a bumper 5400, for installation onto a tennis racket, according to an embodiment of the present invention. FIG. 55 illustrates a lower perspective view of the bumper 5400, FIG. 56 illustrates a top view of the bumper 5400, and FIG. 57 illustrates an enlarge portion of the bumper 5400 corresponding to Area J of FIG. 56.

The bumper 5400 comprises a plastic insert that extends around the top of the head of the racquet. In particular, the bumper 5400 comprises first and second lower ends 5405, between which an upper loop portion 5410 extends. The bumper 5400 conforms closely to the shape of the tennis racket, as it fits snugly to an outside of the tennis racket.

The bumper 5400 may attach to grommets (not shown) through which strings of the racket extend. Alternatively, the bumper 5400 may include apertures and grommets, such that the strings of the racket extend through the bumper.

The bumper 5400 includes plurality of dimples 3605 arranged on an outer surface thereof, to provide improved aerodynamics of the tennis racket. The dimples 3605 are arranged in rows 5415 from a front to rear of the racket, and thus aligned with a flow of air across the racket when swung.

The terms front and rear are interchangeable in this context, as the tennis racket is generally symmetrical, meaning that the front may become the rear and vice versa, depending on the direction it is swung.

The bumper 5400 protects the frame and strings, particularly if the racket is dropped or makes contact with a surface. The bumper 5400 may wear, and thus may be replaced, without replacing the tennis racket.

The bumper may also absorb some of the shock and vibration occurring when the ball strikes the strings, especially on shots that either miss the sweet spot or are hit with power.

While the bumper is shown to include dimples arranged in rows, any other suitable arrangement may be used. In some embodiments, the dimples may be offset from each other (rather than in rows), or even arranged in a semi-random arrangement.

Figure 58:
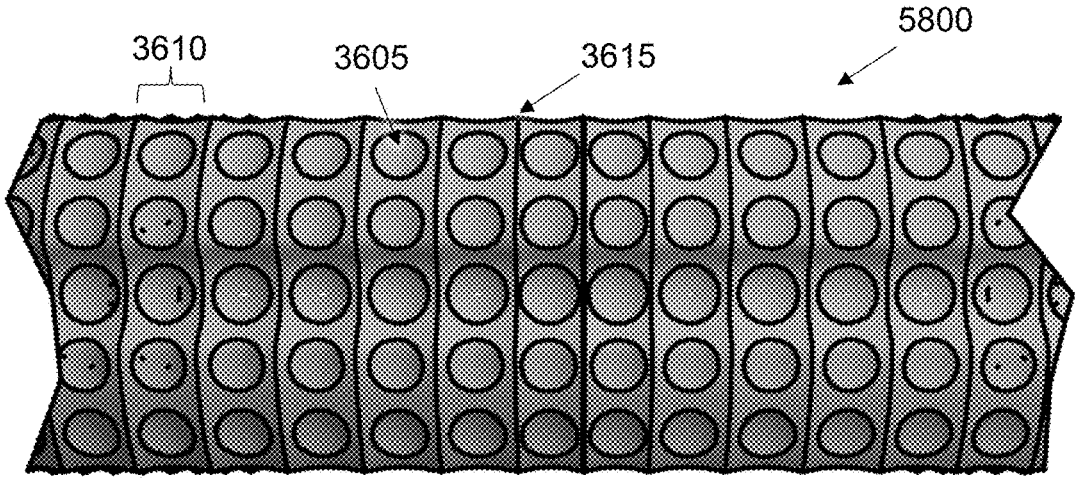
FIG. 58 illustrates an enlarged portion of a bumper, similar to the bumper of FIG. 54, but in which the dimples are provided in channels defined by ridges, and as such, much like the rackets described above.

FIG. 58 illustrates an enlarged portion of a bumper 5800, similar to the bumper 5400, but in which the dimples 3605 are provided in channels 3610 defined by ridges 3615, and as such, much like the rackets described above.

The bumper 5800 is more aerodynamic than bumpers with dimples alone.

The tennis rackets and bumpers described above are advantageously made of a carbon fibre, graphene yarn, or similar material, with resin.

Preferably, a mould is used, being the shape of the racket or bumper, in which carbon fibre, graphene yarn, or similar material is placed. Air or another gas is injected into the mould, pushing the carbon fibre, graphene yarn, or similar material against the mould, where it is cured. This may be performed by simultaneously heating the material, or any other suitable process. Alternatively, blow moulding or vacuum moulding may be used.

As such, the mould may include the dimples, channels, ridges or similar surface formations, alleviating the need to separately incorporate such elements into the racket or bumper at a later stage.

The teachings above presented in the context of golf clubs, tennis rackets, helmets and the like may be applied to a wide range of other items, without deviating from the invention.

As an illustrative example, the arrangement of dimples, channels and ridges described above in relation to the tennis rackets, may be applied to other items, including sporting items, such as motorcycle or bicycle helmets.

In one embodiment, rows of channels extend in a direction from a front to a rear of the helmet, with ridges separating the channels. Dimples are then arranged in one or more rows in the channels.

The helmet may include one or more air vents. One or more of the channels may be associated with an air vent, e.g. configured to encourage the flow of air in relation to the air vent.

In other embodiments, the arrangement of dimples, channels and ridges may be used in relation to other items, to improve aerodynamics thereof. The arrangement of dimples, channels and ridges may be incorporated onto the item at the time of manufacture, or added later. In some embodiments, a film may be provided with the dimples, channels and ridges, and applied onto the item using the film.

In addition to providing improved aerodynamics, the use of dimples, channels and ridges outlined above may also increase the strength of the item compared to a flat surface.

By changing the aerodynamics of sporting articles, as described above, stress and tension is taken off the user's body, including the pelvis and hips, back, elbows, shoulders, neck, wrist and soft tissue areas of the body.

The surface features decrease drag of the sporting article without substantially altering the shape of the sporting article. This enables improved aerodynamics to be achieved while maintaining compliance with rules and standards, such as USGA and R & A rules in the case of golf clubs. With improved aerodynamics, less exertion may be required to swing the sporting article at a desired speed, which in turn may be associated with a reduced risk of injury. Alternatively, the improved aerodynamics may be used to increased swing speeds.

The above embodiments are illustrative only, and the skilled addressee will readily appreciate that the any suitable pattern or configuration of dimples or impressions may be used on any part of the golf club, sporting implement or helmet, including the use of multiple patterns or configurations on different parts of the golf club, sporting implement or helmet.

The dimples or impressions described above may have any suitable depth, and may include a depth that is proportional to the diameter of the dimple or impression. Furthermore, the depth of the dimple or impression, or the depth relative to the diameter, may be chosen such that it provides maximum (or near maximum) efficiency in use.

Such maximum efficiency may include reference to the speed in which air travels over parts of the golf club, sporting implement or helmet and in which direction and take into account the aerodynamic properties and efficiency of the golf club, sporting implement or helmet. As an illustrative example, if the golf club, sporting implement or helmet is designed to travel in a particular direction, the dimples or impressions may be configured to increase the aerodynamic properties and efficiency of the golf club, sporting implement or helmet when travelling in such direction.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An aerodynamic sporting item including:

a plurality of ridges on a surface of the sporting item, the ridges aligned with a direction of flow of air across the sporting item when used, the ridges defining channels between adjacent pairs of ridges; and a plurality of dimples located in the channels defined by the ridges, wherein each dimple extends across at least 50% of a width of a corresponding channel.

2. The sporting item of claim 1, wherein the dimples are arranged in one or more rows in the channels.

3. The sporting item of claim 2, wherein the dimples are arranged in a single row in each of the channels.

4. The sporting item of claim 1, wherein the sporting item comprises an implement configured to be swung by a user, the channels aligned with the direction of flow of air across the sporting implement when swung.

5. The sporting item of claim 4, wherein the sporting implement comprises a tennis racket.

6. The sporting item of claim 5, wherein the tennis racket comprises a handle and a frame extending from the handle, wherein at least 50% of a surface of the frame is covered with dimples.

7. The sporting item of claim 4, wherein the one or more rows of dimples are perpendicular to a striking face of the sporting implement.

8. The sporting item of claim 4, further comprising a chamber defined in the sporting implement, the chamber including one or more weights movable within the chamber to adjust a balance of the sporting implement.

9. The sporting item of claim 8, including a handle, wherein the chamber is defined in the handle.

10. The sporting item of claim 1, wherein the dimples comprise spherical dimples.

11. The sporting item of claim 10, wherein the dimples are between about 0.4 mm and 1.0 mm in depth and between about 1.0 mm and 5.0 mm in diameter.

12. The sporting item of claim 1, wherein the channels are curved in cross section.

13. The sporting item of claim 12, wherein the channels curve continuously between adjacent pairs of ridges.

14. The sporting item of claim 1, wherein the ridges comprise an elongate point between adjacent channels.

15. The sporting item of claim 1, wherein the channels are between about 0.2 mm and 3 mm in depth and 5 mm in width.

16. The sporting item of claim 1, wherein the sporting item comprises a helmet configured to be worn by a user.

17. The sporting item of claim 16, wherein the dimples are arranged in one or more rows in the channels, the one or more rows extending in a direction from a front to a rear of a helmet.

18. The sporting item of claim 16, wherein one or more of the channels are associated with an air vent, the one or more channels configured to encourage the flow of air in relation to the air vent.

19. A bumper for a tennis racket, the bumper including:

a plurality of ridges on an outer surface of the bumper, the ridges configured to be aligned with a direction of flow of air across the tennis racket when installed on a racket and the racket is swung, the ridges defining channels between adjacent pairs of ridges; and a plurality of dimples located in the channels defined by the ridges, wherein each dimple extends across at least 50% of a width of a corresponding channel.

* * * * *